US006138774A

United States Patent [19]

Bourgoyne, Jr. et al.

[11] Patent Number: 6,138,774

[45] Date of Patent: Oct. 31, 2000

[54] METHOD AND APPARATUS FOR DRILLING A BOREHOLE INTO A SUBSEA ABNORMAL PORE PRESSURE ENVIRONMENT

[75] Inventors: Adam T. Bourgoyne, Jr.; Darryl A. Bourgoyne; Tammy T. Bourgoyne, all of Baton Rouge, La.

[73] Assignee: Weatherford Holding U.S., Inc., Houston, Tex.

[21] Appl. No.: 09/033,190

[22] Filed: Mar. 2, 1998

[51] Int. Cl.[7] ..... E21B 7/128

[52] U.S. Cl. ..... 175/7; 175/5; 175/214; 175/217

[58] Field of Search ..... 175/7, 5, 214, 175/217

[56] References Cited

U.S. PATENT DOCUMENTS

| | | | |
|---|---|---|---|
| D. 282,073 | 1/1986 | Bearden et al. | D15/21 |
| 517,509 | 4/1894 | Williams . | |
| 1,157,644 | 10/1915 | London . | |
| 1,472,952 | 11/1923 | Anderson . | |
| 1,503,476 | 8/1924 | Childs et al. . | |
| 1,528,560 | 3/1925 | Myers et al. . | |
| 1,546,467 | 7/1925 | Bennett . | |
| 1,560,763 | 11/1925 | Collins . | |
| 1,700,894 | 2/1929 | Joyce et al. . | |
| 1,708,316 | 4/1929 | MacClatchie . | |
| 1,769,921 | 7/1930 | Hansen . | |
| 1,776,797 | 9/1930 | Sheldon . | |
| 1,813,402 | 7/1931 | Hewitt . | |
| 1,831,956 | 11/1931 | Harrington . | |
| 1,836,470 | 12/1931 | Humason et al. . | |
| 1,902,906 | 3/1933 | Seamark . | |
| 1,942,366 | 1/1934 | Seamark | 166/14 |
| 2,036,537 | 4/1936 | Otis | 255/1 |
| 2,071,197 | 2/1937 | Burns et al. | 286/26 |
| 2,124,015 | 7/1938 | Stone et al. | 166/15 |
| 2,126,007 | 8/1938 | Guiberson et al. | 255/1 |
| 2,144,682 | 1/1939 | MacClatchie | 255/1 |
| 2,163,813 | 6/1939 | Stone et al. | 166/14 |
| 2,165,410 | 7/1939 | Penick et al. | 255/1 |
| 2,170,915 | 8/1939 | Schweitzer | 286/16 |
| 2,170,916 | 8/1939 | Schweitzer et al. | 255/1 |
| 2,175,648 | 10/1939 | Roach | 166/14 |
| 2,176,355 | 10/1939 | Otis | 255/1 |
| 2,185,822 | 1/1940 | Young | 285/97.9 |
| 2,199,735 | 5/1940 | Beckman | 255/1 |
| 2,222,082 | 11/1940 | Leman et al. | 255/1 |
| 2,233,041 | 2/1941 | Alley | 166/14 |
| 2,243,340 | 5/1941 | Hild | 255/1 |
| 2,243,439 | 5/1941 | Pranger et al. | 255/1 |

(List continued on next page.)

OTHER PUBLICATIONS

Composite Catalog, Hughes Offshore 1986–87 Subsea Systems and Equipment, Hughes Drilling Equipment (pp. 2986–3004).

(List continued on next page.)

*Primary Examiner*—Hoang Dang
*Attorney, Agent, or Firm*—Akin, Gump, Strauss, Hauer & Feld, L.L.P.

[57] ABSTRACT

An apparatus for controlling a subsea borehole fluid pressure is proposed for use with a conductor casing positioned below the mudline and within a normal pore pressure environment. The apparatus includes a pump for moving a fluid through a tubular into a borehole. The fluid, before being pumped, exerts a pressure less than the pore pressure of an abnormal pore pressure environment. The fluid in the borehole is then pressurized by the pump to at least a borehole pressure equal to or greater than the pore pressure of an abnormal pore pressure environment. A pressure housing assembly allows for the drilling of a borehole below the conductor casing into an abnormal pore pressure environment while maintaining the pressurized fluid between a borehole pressure equal to or greater than the pore pressure of the abnormal pore pressure environment, and below the fracture pressure of the borehole in the abnormal pore pressure environment. Advantageously, a method is provided for drilling a borehole into the subsea abnormal pore pressure environment.

18 Claims, 14 Drawing Sheets

U.S. PATENT DOCUMENTS

| | | | |
|---|---|---|---|
| 2,287,205 | 6/1942 | Stone | 286/16 |
| 2,303,090 | 11/1942 | Pranger et al. | 255/19 |
| 2,313,169 | 3/1943 | Penick et al. | 166/14 |
| 2,325,556 | 7/1943 | Taylor, Jr. et al. | 309/4 |
| 2,338,093 | 1/1944 | Caldwell | 255/23 |
| 2,480,955 | 9/1949 | Penick | 285/22 |
| 2,506,538 | 5/1950 | Bennett | 255/23 |
| 2,529,744 | 11/1950 | Schweitzer | 286/16 |
| 2,609,836 | 9/1952 | Knox | 137/618 |
| 2,628,852 | 2/1953 | Voytech | 286/11.14 |
| 2,646,999 | 7/1953 | Barske | 286/9 |
| 2,649,318 | 8/1953 | Skillman | 286/19 |
| 2,731,281 | 1/1956 | Knox | 286/16.1 |
| 2,746,781 | 5/1956 | Jones | 288/2 |
| 2,760,750 | 8/1956 | Schweitzer, Jr. et al. | 251/2 |
| 2,760,795 | 8/1956 | Vertson | 286/11.15 |
| 2,764,999 | 10/1956 | Stanbury | 138/31 |
| 2,808,229 | 10/1957 | Bauer et al. | 255/2.5 |
| 2,808,230 | 10/1957 | McNeill et al. | 255/2.5 |
| 2,846,178 | 8/1958 | Minor | 251/2 |
| 2,846,247 | 8/1958 | Davis | 286/16.1 |
| 2,853,274 | 9/1958 | Collins | 255/23 |
| 2,862,735 | 12/1958 | Knox | 286/16.2 |
| 2,886,350 | 5/1959 | Horne | 286/9 |
| 2,904,357 | 9/1959 | Knox | 286/16.1 |
| 2,927,774 | 3/1960 | Ormsby | 255/23 |
| 2,995,196 | 8/1961 | Gibson et al. | 175/7 |
| 3,023,012 | 2/1962 | Wilde | 277/31 |
| 3,029,083 | 4/1962 | Wilde | 277/164 |
| 3,033,011 | 5/1962 | Garrett | 64/11 |
| 3,052,300 | 9/1962 | Hampton | 166/84 |
| 3,100,015 | 8/1963 | Regan | 166/46 |
| 3,128,614 | 4/1964 | Auer | 64/23.5 |
| 3,134,613 | 5/1964 | Regan | 285/142 |
| 3,176,996 | 4/1965 | Barnett | 277/2 |
| 3,203,358 | 8/1965 | Regan et al. | 103/203 |
| 3,216,731 | 11/1965 | Dollison | 277/1 |
| 3,225,831 | 12/1965 | Knox | 166/75 |
| 3,268,233 | 8/1966 | Brown | 277/31 |
| 3,285,352 | 11/1966 | Hunter | 175/214 |
| 3,288,472 | 11/1966 | Watkins | 277/11 |
| 3,289,761 | 12/1966 | Smith et al. | 166/27 |
| 3,294,112 | 12/1966 | Watkins | 137/494 |
| 3,323,773 | 6/1967 | Walker | 251/1 |
| 3,333,870 | 8/1967 | Watkins | 285/18 |
| 3,347,567 | 10/1967 | Watkins | 285/24 |
| 3,360,048 | 12/1967 | Watkins | 166/87 |
| 3,387,851 | 6/1968 | Cugini | 277/2 |
| 3,400,938 | 9/1968 | Williams | 277/31 |
| 3,445,126 | 5/1969 | Watkins | 285/85 |
| 3,452,815 | 7/1969 | Watkins | 166/0.5 |
| 3,472,518 | 10/1969 | Harlan | 277/31 |
| 3,485,051 | 12/1969 | Watkins | 61/46.5 |
| 3,492,007 | 1/1970 | Jones | 277/31 |
| 3,493,043 | 2/1970 | Watkins | 166/0.5 |
| 3,529,835 | 9/1970 | Lewis | 277/2 |
| 3,603,409 | 9/1971 | Watkins | 175/7 |
| 3,621,912 | 11/1971 | Wooddy, Jr. | 166/0.5 |
| 3,631,834 | 1/1972 | Gardner et al. | 115/34 R |
| 3,638,721 | 2/1972 | Harrison | 175/7 |
| 3,638,742 | 2/1972 | Wallace | 175/325 |
| 3,653,350 | 4/1972 | Koons et al. | 114/0.5 R |
| 3,661,409 | 5/1972 | Brown et al. | 285/82 |
| 3,664,376 | 5/1972 | Watkins | 137/625.68 |
| 3,667,721 | 6/1972 | Vujasinovic | 251/1 |
| 3,677,353 | 7/1972 | Baker | 175/25 |
| 3,724,862 | 4/1973 | Biffle | 277/31 |
| 3,779,313 | 12/1973 | Regan | 166/0.6 |
| 3,827,511 | 8/1974 | Jones | 175/25 |
| 3,868,832 | 3/1975 | Biffle | 64/23.5 |
| 3,934,887 | 1/1976 | Biffle | 277/31 |
| 3,952,526 | 4/1976 | Watkins et al. | 61/46 |
| 3,955,622 | 5/1976 | Jones | 166/0.5 |
| 3,965,987 | 6/1976 | Biffle | 166/315 |
| 3,984,990 | 10/1976 | Jones | 61/99 |
| 3,992,889 | 11/1976 | Watkins et al. | 61/86 |
| 3,999,766 | 12/1976 | Barton | 277/28 |
| 4,037,890 | 7/1977 | Kurita et al. . | |
| 4,046,191 | 9/1977 | Neath | 175/7 |
| 4,098,341 | 7/1978 | Lewis | 166/314 |
| 4,109,712 | 8/1978 | Regan | 166/340 |
| 4,143,880 | 3/1979 | Bunting et al. | 277/31 |
| 4,143,881 | 3/1979 | Bunting | 277/31 |
| 4,149,603 | 4/1979 | Arnold | 175/7 |
| 4,154,448 | 5/1979 | Biffle | 277/31 |
| 4,157,186 | 6/1979 | Murray et al. | 277/31 |
| 4,183,562 | 1/1980 | Watkins et al. | 285/405 |
| 4,200,312 | 4/1980 | Watkins | 285/18 |
| 4,208,056 | 6/1980 | Biffle | 277/31 |
| 4,222,590 | 9/1980 | Regan | 285/14 |
| 4,281,724 | 8/1981 | Garrett | 175/195 |
| 4,285,406 | 8/1981 | Garrett et al. | 175/195 |
| 4,291,772 | 9/1981 | Beynet | 175/7 |
| 4,293,047 | 10/1981 | Young | 175/195 |
| 4,304,310 | 12/1981 | Garrett | 175/195 |
| 4,312,404 | 1/1982 | Morrow | 166/84 |
| 4,326,584 | 4/1982 | Watkins | 166/82 |
| 4,349,204 | 9/1982 | Malone | 277/34 |
| 4,355,784 | 10/1982 | Cain | 251/63 |
| 4,361,185 | 11/1982 | Biffle | 166/84 |
| 4,363,357 | 12/1982 | Hunter | 166/84 |
| 4,367,795 | 1/1983 | Biffle | 166/84 |
| 4,383,577 | 5/1983 | Pruitt | 166/95 |
| 4,398,599 | 8/1983 | Murray | 166/95 |
| 4,406,333 | 9/1983 | Adams | 175/209 |
| 4,413,653 | 11/1983 | Carter, Jr. | 138/89 |
| 4,416,340 | 11/1983 | Bailey | 175/195 |
| 4,423,776 | 1/1984 | Wagoner et al. | 166/84 |
| 4,424,861 | 1/1984 | Carter, Jr. et al. | 166/120 |
| 4,441,551 | 4/1984 | Biffle | 166/84 |
| 4,444,250 | 4/1984 | Keithahn et al. | 166/84 |
| 4,444,401 | 4/1984 | Roche et al. | 277/30 |
| 4,448,255 | 5/1984 | Shaffer et al. | 166/387 |
| 4,456,062 | 6/1984 | Roche et al. | 166/84 |
| 4,456,063 | 6/1984 | Roche | 166/84 |
| 4,480,703 | 11/1984 | Garrett | 175/195 |
| 4,486,025 | 12/1984 | Johnston | 277/31 |
| 4,500,094 | 2/1985 | Biffle | 277/31 |
| 4,502,534 | 3/1985 | Roche et al. | 166/84 |
| 4,524,832 | 6/1985 | Roche et al. | 166/347 |
| 4,526,243 | 7/1985 | Young | 175/195 |
| 4,529,210 | 7/1985 | Biffle | 277/31 |
| 4,531,580 | 7/1985 | Jones | 166/84 |
| 4,546,828 | 10/1985 | Roche | 166/84 |
| 4,566,494 | 1/1986 | Roche | 137/872 |
| 4,597,447 | 7/1986 | Roche et al. | 166/347 |
| 4,618,314 | 10/1986 | Hailey | 417/53 |
| 4,621,655 | 11/1986 | Roche | 137/81.2 |
| 4,626,135 | 12/1986 | Roche | 405/195 |
| 4,646,844 | 3/1987 | Roche et al. | 166/379 |
| 4,697,484 | 10/1987 | Klee et al. | 82/1.5 |
| 4,719,937 | 1/1988 | Roche et al. | 137/114 |
| 4,745,970 | 5/1988 | Bearden et al. | 165/84 |
| 4,754,820 | 7/1988 | Watts et al. | 175/195 |
| 4,768,590 | 9/1988 | Sanford et al. | 166/187 |
| 4,783,084 | 11/1988 | Biffle | 277/9 |
| 4,813,495 | 3/1989 | Leach | 175/6 |
| 4,825,938 | 5/1989 | Davis | 166/84 |
| 4,828,024 | 5/1989 | Roche | 166/84 |
| 4,832,120 | 5/1989 | Coronado | 166/187 |
| 4,832,126 | 5/1989 | Roche | 166/358 |
| 4,836,289 | 6/1989 | Young | 166/379 |

| | | | |
|---|---|---|---|
| 4,909,327 | 3/1990 | Roche | 166/359 |
| 4,949,796 | 8/1990 | Williams | 175/209 |
| 4,971,148 | 11/1990 | Roche et al. | 166/88 |
| 4,979,570 | 12/1990 | Mody | 166/387 |
| 5,022,472 | 6/1991 | Bailey et al. | 175/195 |
| 5,028,056 | 7/1991 | Bemis et al. | 277/227 |
| 5,101,908 | 4/1992 | Mody | 166/387 |
| 5,137,084 | 8/1992 | Gonzales et al. | 166/84 |
| 5,178,215 | 1/1993 | Yenulis et al. | 166/80 |
| 5,213,158 | 5/1993 | Bailey et al. | 166/82 |
| 5,215,151 | 6/1993 | Smith et al. | 175/45 |
| 5,224,557 | 7/1993 | Yenulis et al. | 175/195 |
| 5,376,726 | 12/1994 | Noyama et al. | 525/193 |
| 5,417,289 | 5/1995 | Carisella | 166/387 |
| 5,487,352 | 1/1996 | Williams et al. | 116/218 |
| 5,647,444 | 7/1997 | Williams | 175/209 |
| 5,662,181 | 9/1997 | Williams et al. | 175/195 |

OTHER PUBLICATIONS

Williams Tool Co., Inc., Technical Specifications Model for the Model 7100, (3 pages).

Williams Tool Co., Inc. Website, Underbalanced Drilling (UBD), The Attraction of UBD (2 pages).

Williams Tool Co., Inc. Website, "Applications, Where Using a Williams Rotating Control Head While Drilling is a Plus" (2 pages).

Williams Tool Co., Inc. Website, "Model 7100," (3 pages).

Composite Catalog, Hughes Offshore 1982/1983, Regan Products, © Copyright 1982, (Two cover sheets and 4308–27 thru 4308–43, and end sheet).

Coflexip Brochure; Coflexip Sales Offices, The Flexible Steel Pipe for Drilling and Service Applications, New 5" I.D. General Drilling Flexible, Applications, (5 unnumbered pages).

Baker, Ron, "A Primer of Oilwell Drilling", Fourth Edition, Published by Petroleum Extension Service, The University of Texas at Austin, Austin, Texas, in cooperation with International Association of Drilling Contractors Houston Texas © 1979, (3 cover pages and pp. 42–49 re Circulation System).

Brochure, Lock down Lubricator System, Dutch Enterprises Inc., "Safety with Savings," (16 unnumbered pages).

Hydril GL series Annular Blowout Preventers (Patented), (2 pages).

Other Hydril Product Information (The GH Gas Handler Series Product is Listed), © 1996, Hydril Company (19 pages).

Brochure, Shaffer Type 79 Rotating Blowout Preventer, NL Rig Equipment/NL Industries, Inc., (6 unnumbered pages).

Shaffer Composite Catalog Entry (Pressure Control While Drilling Rotating Blowout Preventer), (Cover page and pp. 1562–1568).

Avoiding Explosive Unloading of Gas in a Deepwater Riser When SOBM is in Use; Leach & Roche—1998 (The Paper Describes an Application for the Hydril Gas Handler, The Hydril GH 211–2000 Gas Handler is Depicted in Figure 1 of the Paper), (9 unnumbered pages).

Feasibility Study of Dual Density Mud System for Deepwater Drilling Operations; Lopes & A.T. Bourgoyne Jr.—1997 (Offshore Technology Conference Paper Number 8465), (pp. 257–266).

A Subsea Rotating Control Head for Riserless Drilling Applications; Bourgoyne, Bourgoyne, and Hannegan—1998 (International Association for Drilling Contractors International Deepwater Well Control Conference Held in Houston Texas, Aug. 26–27), (14 pages).

Apr. 1998 Offshore Drilling with Light Weight Fluids Joint Industry Project Presentation, (9 unnumbered pages).

Nakagawa, Edson Y., Santos, Helio and Cunha, J.C., "Application of Aerated–Fluid Drilling in Deepwater", SPE/IADC 52787 Presented by Don Hannegan, P.E., SPE © 1999 SPE/IADC Drilling Conference, Amsterdam, Holland, Mar. 9–11, 1999 (5 unnumbered pages).

Brochure: "Inter–Tech Drilling Solutions Ltd.'s RBOP® Means Safety and Experience for Underbalanced Drilling", Inter–Tech Drilling Solutions Ltd./Big D Rentals & Sales (1981) Ltd. and Color Copy of "Rotating BOP" (2 unnumbered pages).

"Pressure Control While Drilling", Shaffer® A Varco Company, Rev. A (2 unnumbered pages).

Field Exposure (As of Aug. 1998), Shaffer® A Varco Company (1 unnumbered page).

Graphic: "Rotating Spherical BOP" (1 unnumbered page).

Applied Drilling Engineering, ©1986 by the Society of Petroleum Engineers, Richardson, TX, (58 pages) Adam T. Bourgoyne, Jr., co–author, pp. 245–299.

The Modular T BOP Stack System A Subsea System That Increases Strength, Saves Space, And Reduces Maintenance, Cameron Iron Works © 1985 (5 pages).

Cameron HC Collet Connector ©1996 Cooper Cameron Corporation, Cameron Division (12 pages).

Letter dated Aug. 2, 1996 to Colin P. Leach, President of Well Control & Systems Design re Riserless Drilling—Seafloor Rotating Control Head Application from Don Hannegan, P.E., IIE, SPE, Vice President/General Manager of Williams Tool Co. (1 page); letter dated Aug. 6, 1996, to D. Hannegan of Williams Tool Co. re Approach to Drilling Deepwater Wells from Colin Leach (1 page); and a letter dated Aug. 16, 1996 to Dr. Ted Bourgoyne re Approach to Drilling Deepwater Wells via "Riserless Drilling" from Don Hannegan (1 page).

Letter dated May 16, 1996 to John and Vinson re possible use of a Model 7100 RCH in Riserless deepwater drilling from Don Hannegan (1 page).

Riserless drilling: circumventing the size/cost cycle in deepwater—Conoco, Hydril project seek enabling technologies to drill in deepest water depths economically, May 1996 Offshore Drilling Technology (pp. 49, 50, 52, 53, 54 and 55).

Williams Tool Company—Home Page—Under Construction Williams Rotating Control Heads (2 pages); Seal–Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications Where using a Williams rotating control head while drilling is a plus (1 page); Williams higher pressure rotating control head systems are ideally suited for new technology flow drilling and closed loop underbalanced drilling (UBD) vertical and horizontal (2 pages); and How to Contact Us (2 pages).

Offshore—World Trends and Technology for Offshsore Oil and Gas Operations, Mar. 1998, Seismic: More, better, faster, cheaper (3 pages including cover page, table of contents and page 90).

Williams Tool Co., Inc. Rotating Control Heads and Strippers for Air, Gas, Mud, and Geothermal Drilling Worldwide—Sales Rental Service, ©1988 (19 pages).

Williams Tool Co., Inc. 16 page brochure ©1991 Williams Tool Co., Inc. (20 pages).

Fig. 14. Floating Piston Drilling Choke Design; May of 1997.
Swaco 1998 Offshore Technology Conference (OTC), May 4–7, 1998, Webvertising® (1 page).
Blowout Preventer Testing for Underbalanced Drilling by Charles R. "Rich" Stone and Larry A. Cress, Signa Engineering Corp., Houston, Texas (24 pages) Sep. 1997.
Williams Tool Co., Inc. Instructions, Assemble & Dissassemble Model 9000 Bearing Assembly (cover page and 27 unnumbered pages).
Williams Tool Co., Inc. Rotating Control Heads Making Drilling Safer While Reducing Costs Since 1968, ©1989 (4 pages).
Williams Tool Company, Inc. International Model 7000 Rotating Control Head, © 1991 (4 pages).
Williams Rotating Control Heads, Reduce Costs Increase Safety Reduce Environmental Impact (4 pages).
Williams Tool Co., Inc., Sales Rental Service, Williams Rotating Control Heads and Strippers for Air, Gas, Mud, and Geothermal Drilling, © 1982 (7 pages).
Williams Tool Co., Inc., Rotating Control Heads and Strippers for Air, Gas, Mud, Geothermal and Pressure Drilling, © 1991 (19 pages).
An article—The Brief Jan. '96, The Brief's Guest Columnists, Williams Tool Co., Inc., Communicating Dec. 13, 1995 (Fort Smith, Arkansas) The When? and Why? of Rotating Control Head Usage, Copyright © Murphy Publishing, Inc. 1996 (2 pages).
A reprint from the Oct. 9, 1995 edition of Oil & Gas Journal, "Rotating control head applications increasing", by Adam T. Bourgoyne, Jr., Copyright 1995 by PennWell Publishing Company (6 pages).
1966–1977 Composite Catalog Grant Rotating Drilling Head for Air, Gas or Mud Drilling, (1 page).
1976–1977 Composite Catalog Grant Oil Tool Company Rotating Drilling Head Models 7068, 7368, 8068, Equally Effective with Air, Gas, or Mud Circulation Media (3 pages).
JPT Drilling & Completion Fluids, Drilling & Completion Fluids Update (10 Technical Features) (1 page).
A Subsea Rotating Control Head for Riserless Drilling Applications, Darryl A. Bourgoyne, BEI; Adam T. Bourgoyne, Jr., Louisiana State University; and Don Hannegan, Williams Tool Company, Inc. Copyright 1998 (pp. 1–14).
Williams Tool Co., Inc., "Rotating Control Heads and Strippers for Air, Gas, Mud, and Geothermal Drilling," pp. 1–16, Fort Smith, Arkansas 1988.
Williams Tool Co., Inc., "Rotating Control Heads and Strippers for Air, Gas, Mud, Geothermal and Horizontal Drilling," pp. 1–16, Fort Smith, Arkansas 1991.
Akzo Nobel Fibers, Inc., ":Trelleborg—Use of Trell–MB in Rubber," pp. 1–2, Conyers, Georgia 1991.
Akzo Nobel Fibers, Inc., ":Trelleborg—Trell–MB Masterbatch," p. 1, Conyers, Georgia 1991.
Hannegan, "Applications Widening for Rotating Control Heads," Drilling Contractor, pp. 17–19, Drilling Contractor Publications Inc., Houston, Texas Jul., 1996.

66
38
15A
54
98
52
90'
ABOP
BOPS
126
110
100
10
94

METHOD AND APPARATUS FOR DRILLING A BOREHOLE INTO A SUBSEA ABNORMAL PORE PRESSURE ENVIRONMENT

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The present invention relates to a method and apparatus for drilling a borehole into a subsea abnormal pore pressure environment. In particular, the present invention discloses a method and apparatus for drilling a borehole through subsea geological formations while maintaining the fluid pressure inside of the borehole equal to or greater than the pore pressure in the surrounding geological formations using a fluid, that is of insufficient density to generate a borehole pressure greater than the surrounding geological formations pore pressures without borehole fluid pressurization.

2. Description of the Related Art

Drilling fluid using additives to provide an elevated density is generally used to control and stabilize a borehole during the drilling process in an abnormal pore pressure environments. In particular, additives, such as barite and clay, are added to the drilling fluid to increase its density and viscosity. When drilling in deep water, a riser has been used to allow the drilling fluid to be circulated back to a floating drilling vessel. The riser must be large enough in diameter to accommodate the largest bit and casing that will be used in drilling the borehole. As drilling is extended into deeper water, the size of the riser becomes difficult to handle with current floating drilling vessels. The use of larger floating vessels to handle larger risers would greatly increase the daily rentals of these vessels (some now approaching $200,000/day), which would make production economical only for high rate producing wells. Therefore, this economic constraint could limit deep water oil and gas developments.

To reduce the cost related to conventional risers, the initial shallow part of the well is often drilled and cased with a conductor tubular or casing without using a riser. In this shallow drilling and casing, an economical single-pass drilling fluid, such as sea water, is used. Therefore, since sea water is used as the drilling fluid it can be discharged into the sea, without having to be pumped back up to the floating vessel.

Sea water may be used as a conventional drilling fluid in a normal pore pressure environment because sea water has sufficient density to control and stabilize a borehole through geological formations in a normal pressured environment throughout the drilling process. In other words, the shallow part of the well can be drilled with conventional techniques into the normal pore pressure environment without a riser because the borehole pressure is controlled by the hydrostatic pressure of the sea water. Later in the well drilling process when a subsea borehole is drilled into an abnormal pore pressure environment, additives to the drilling fluid are commonly used. It has been found that abnormally pressured aquifers are often encountered at very shallow depths in many deepwater geological environments. Most past attempts to drill through these shallow abnormally pressured aquifers with sea water have been unsuccessful. Conventional drilling fluids with additives are not commonly used as a single pass drilling fluid, as is sea water, because the large amount of additives which would have to be discharged during continuous drilling operations would make the process uneconomical.

As best shown in FIG. 1, a flow from a shallow abnormally pressured aquifer 10 washes out sand and soils, such as from the formation and over-lying sediments collapse. The collapse of the sediments can create a flow path 12 in the sea floor SF. This erosion and destabilization of the sea floor can undermine expensive subsea wells and make the site unsuitable for anchoring tension leg platforms and spar platforms. The destabilization of the sea floor can also collapse the casings of previously drilled wells at the site. Thus, this erosion could force the abandonment of locations where hundreds of millions of dollars have been invested. Current practice for minimizing this risk is to batch drill the shallow section of all the wells in a location to a depth below the shallow abnormally pressured aquifers. If the location is lost due to an uncontrolled water flow from the aquifer while following this current practice, the minimum possible investment is lost.

Turning now to FIG. 2, conventional drilling technology using a riser 34 for drilling a subsea borehole is shown. The depth 14 to the top of the abnormal pore pressure environment, in this example, is 1500 feet when referenced to the mudline 16 of the sea floor SF or a depth 18 of 4,780 feet when referenced to the kelly bushing 20 on the rig floor of the floating vessel 22.

An abnormal pore pressure environment is an environment where the hydrostatic pressure of sea water will not control the pore pressure. In other words, an abnormal pore pressure environment is an environment where the hydrostatic pressure generated by a column of sea water is less than the pore fluid pressure of the geological formations surrounding the borehole.

Therefore, the example well in FIG. 2 can be safely drilled using sea water as the drilling fluid to a depth of 1500 feet, since the pore pressure 24A in the normal pore pressure environment is equal to the hydrostatic pressure of sea water (8.6 ppg) 26 down to this depth. In other words, the increase in the pore pressure gradient at 1500 feet, as seen by the slope change at 28, indicates that the maximum casing depth for conductor or the first casing is 1500 feet. Since the maximum setting depth of the first casing in the example well is a function of the pore pressure 24A and the fracture pressure 30, the drilling and casing can be accomplished without a riser using sea water. Therefore, as discussed above, the first portion (the "normal pressure" portion of the well) of the borehole above 1500 feet in this example well is drilled and cased without a riser.

Since the first portion of the borehole (above 1500 feet) can be drilled without a riser, the diameter of the first casing 32 is not limited by the riser 34. However, in this example, the riser 34 (and a drilling fluid having additives) is required when using conventional drilling technology to drill depths greater than 1500 feet. Because casing 36 must pass through the conventional 18 inch diameter clearance blowout preventer (BOP) stack 37 and 18 inch diameter riser 34, selecting a casing size for the first casing 32 which is much larger than the riser 34 and BOP stack 37 clearance is of no benefit. Presently, most floating vessels do not handle risers bigger than 19 inches in diameter. As a result, risers greater than 19 inches in diameter are not used. The cost of upgrading the floating vessel for a larger riser diameter is quite high due to the increase load which would be imposed on the vessel when handling the larger, heavier risers. As a result, the second casing 36 run into the conventional-drilled well, such as shown in FIG. 2, is limited by the riser 34 (18 inches in diameter) and must have clearance to pass through a 18 inch diameter. Therefore, in the example of FIG. 2, selecting the size of the first casing 32 to be as close as possible to the riser 34 diameter is the most cost effective. Thus, the selected size of first and second casings run into the conventionally-drilled example well are 20 inches and 16 inches, respectively. In order to maintain the borehole fluid pressure for the second casing between the pore pressure 24B and the fracture pressure 30, the borehole for the second casing can be drilled to approximately 2,560 feet, as shown graphically in FIG. 2. The line 38 (indicating use of a fluid with additives-a 10.1 ppg mud) is maintained between the pore pressure line 24B and the fracture line 30 with a 200 psi safety margin while being drilled through the shallow aquifer 10 to 2,560 feet.

U.S. Pat. No. 4,813,495 proposes an alternative to the conventional drilling method and apparatus of FIG. 2 by using a subsea rotating control head in conjunction with a subsea pump that returns the drilling fluid to a drilling vessel. Since the drilling fluid is returned to the drilling vessel, a fluid with additives may economically be used for continuous drilling operations. ('495 patent, col. 6, ln. 15 to col. 7, ln. 24) Therefore, the '495 patent moves the base line for measuring pressure gradient from the sea surface to the mudline of the sea floor ('495 patent, col. 1, lns. 31–34). This change in positioning of the base line removes the weight of the drilling fluid or hydrostatic pressure contained in a conventional riser from the formation. This objective is achieved by taking the fluid or mud returns at-the mudline and pumping them to the surface rather than requiring the mud returns to be forced upward through the riser by the downward pressure of the mud column ('495 patent, col. 1, lns. 35–40). Therefore, the '495 patent, while acknowledging the economic and environmental concerns of dumping, proposes the use of drilling fluids with additives that are only dumped to the sea floor in an emergency. ('495 patent, col. 3, lns. 30–35)

SUMMARY OF THE INVENTION

An apparatus for controlling a subsea borehole fluid pressure is proposed for use with a conductor casing positioned below the mudline and within a normal pore pressure environment. The apparatus includes a pump for moving a fluid through a tubular into a borehole. The fluid, before being pumped, exerts a pressure less than the pore pressure of an abnormal pore pressure environment. The fluid in the borehole is then pressurized by the pump to at least a borehole pressure equal to or greater than the pore pressure. A pressure housing assembly includes a rotating control head having a sealed bearing assembly comprising an inner member and outer member. The inner member is rotatable relative to the outer member and has a passage through which the tubular may extend. The tubular is sealed with the rotatable inner barrel. The pressure housing assembly further includes a pressure control device to control pressure in the pressure housing assembly and the pressure housing assembly is sealably positioned with the conductor casing. The pressure housing assembly allows for the drilling of a borehole below the conductor casing into an abnormal pore pressure environment while maintaining sufficient fluid pressurization to maintain a borehole pressure equal to or greater than the pore pressure. The upper limit for borehole fluid pressurization is controlled by formation fracture resistance, and the borehole pressure must be maintained below this pressure. The pressure housing assembly allows for the drilling of a borehole below the conductor casing into an abnormal pore pressure environment while maintaining the borehole fluid pressurization below the fracture pressure of the borehole in the abnormal pore pressure environment. Advantageously, a method is provided for drilling a borehole into the subsea abnormal pore pressure environment.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 12A:
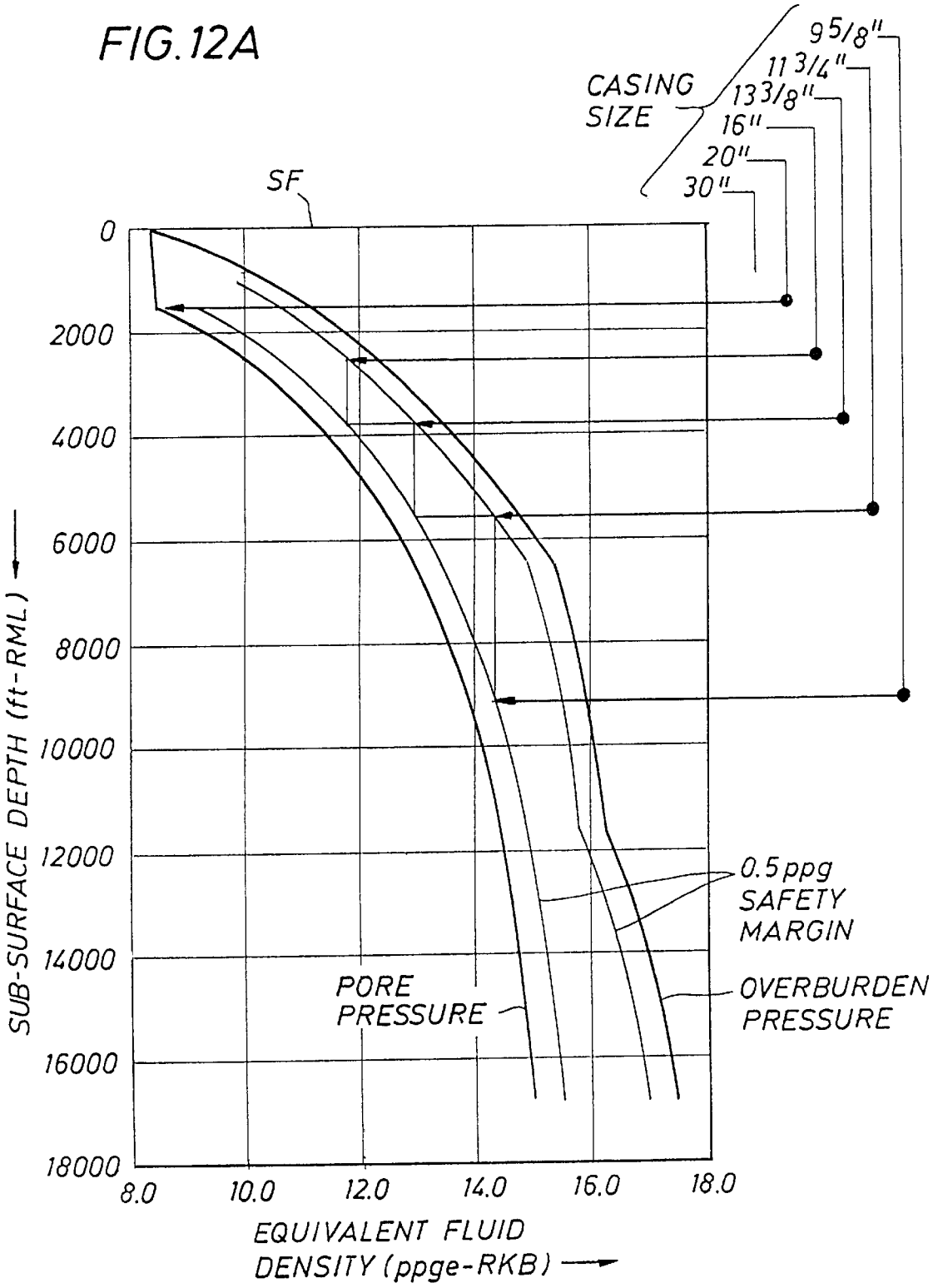
FIG. 12A is a graph of a casing design if conventional drilling techniques and riser sizes are used for drilling the example case discussed in the background of the invention.
Figure 12B:
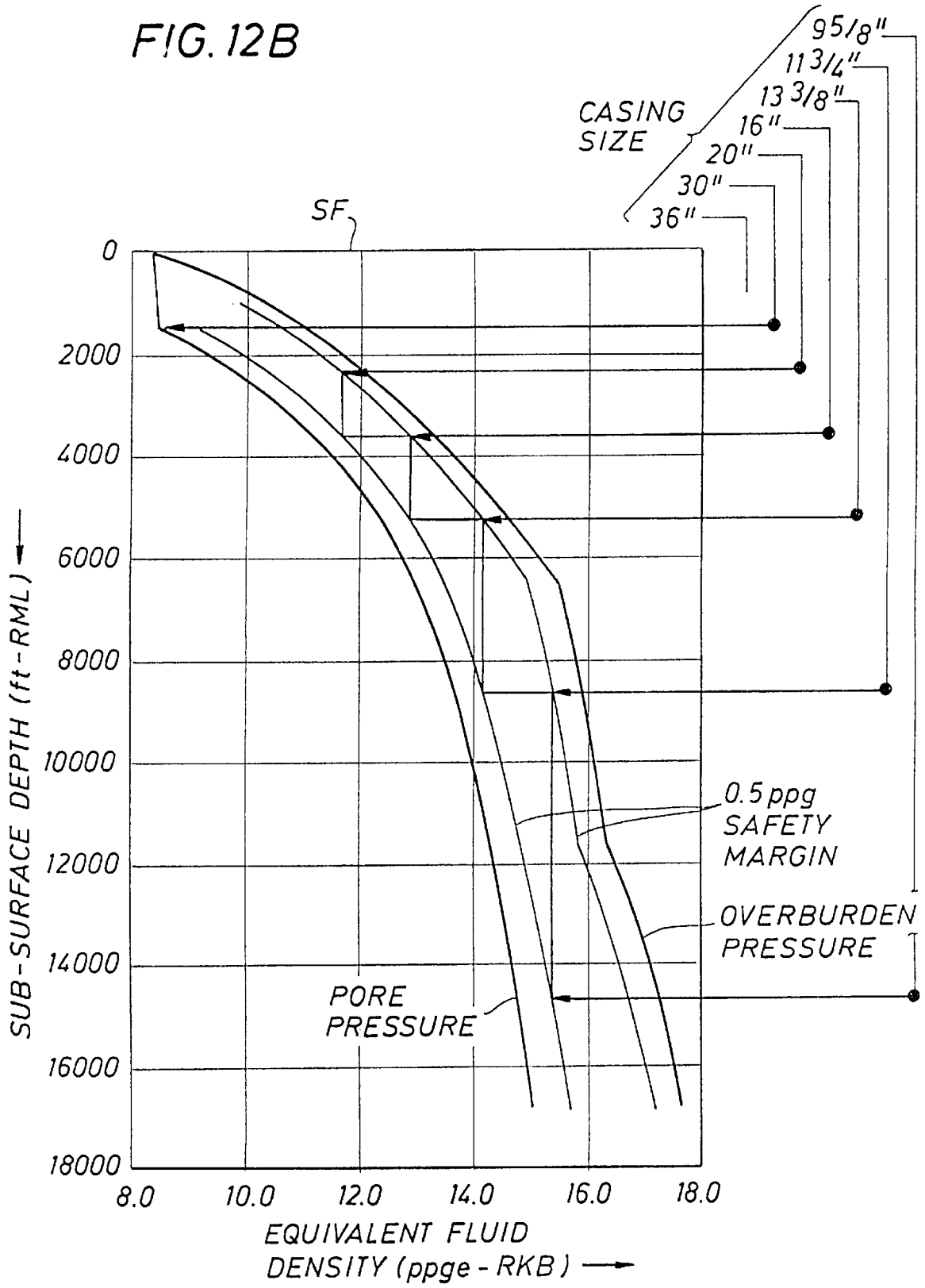
FIG. 12B is a graph of the extended benefits of the present invention providing a second casing of larger diameter than the conventional drilling method, as shown in FIGS. 2 and 12A.
Figure 13:
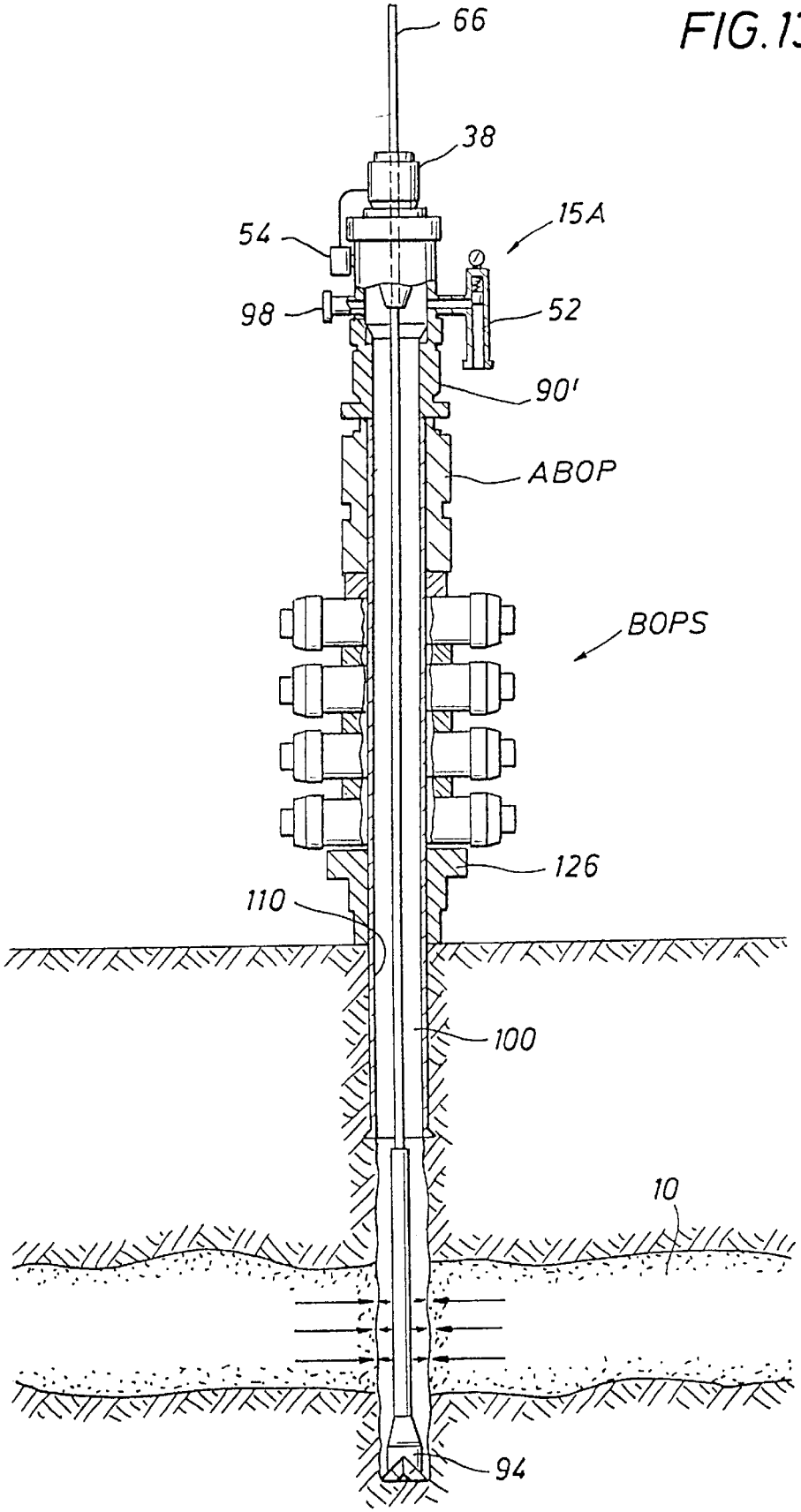
FIG. 13 is an alternative embodiment of the present invention sealingly positioned on a conventional blowout preventer stack attached to a wellhead extending from a conductor casing in a subsea borehole.

The preferred embodiment of the pressure housing assembly 15 is illustrated in FIGS. 3–12 and an alternative embodiment of the pressure housing assembly 15A is illustrated in FIG. 13. The preferred embodiment of a pressure housing assembly, generally indicated at 15, includes a rotating blowout preventer or rotating control head, generally indicated at 38, and best shown in FIGS. 3, 4, 5 and 6. The control head 38 is similar to the rotating blowout preventer disclosed in U.S. Pat. No. 5,662,181, that is assigned to the assignee of the present invention and incorporated herein by reference for all purposes. Contemplated modifications to the '181 rotating blowout preventer include deletion of the kelly driver and the corresponding drive lugs located on the top rubber drive 40. Additionally, the clamp cylinder and drilling mud fill line could be deleted. However, the housing 44 preferably includes three return outlets 46, 48 and 50 (not shown). The return outlets 46 and 50 are preferably connected to redundant choking or pressure control devices, such as pressure control device 52, shown in FIGS. 3 and 6 and as discussed below in detail. The return outlet 48 is used for an orifice valve, as discussed below in detail. Because the pressure housing assembly 15 is preferably self contained, a self contained lubrication unit 54 is preferably provided for communication with the lubricant inlet fitting, as disclosed in the '181 patent, to provide lubrication to the sealed bearing assembly, as discussed below in detail. The self contained pressure housing assembly 15, including the control head 38 and pressure control device 52, will not require long hydraulic hose bundles or electrical wires run from a floating vessel to the sea floor. It is also contemplated that the cooling water inlet and outlet fittings of the rotating blowout preventer of the '181 patent would not be required, in view of the cool subsea environment in which the present invention will be used.

Figure 4:
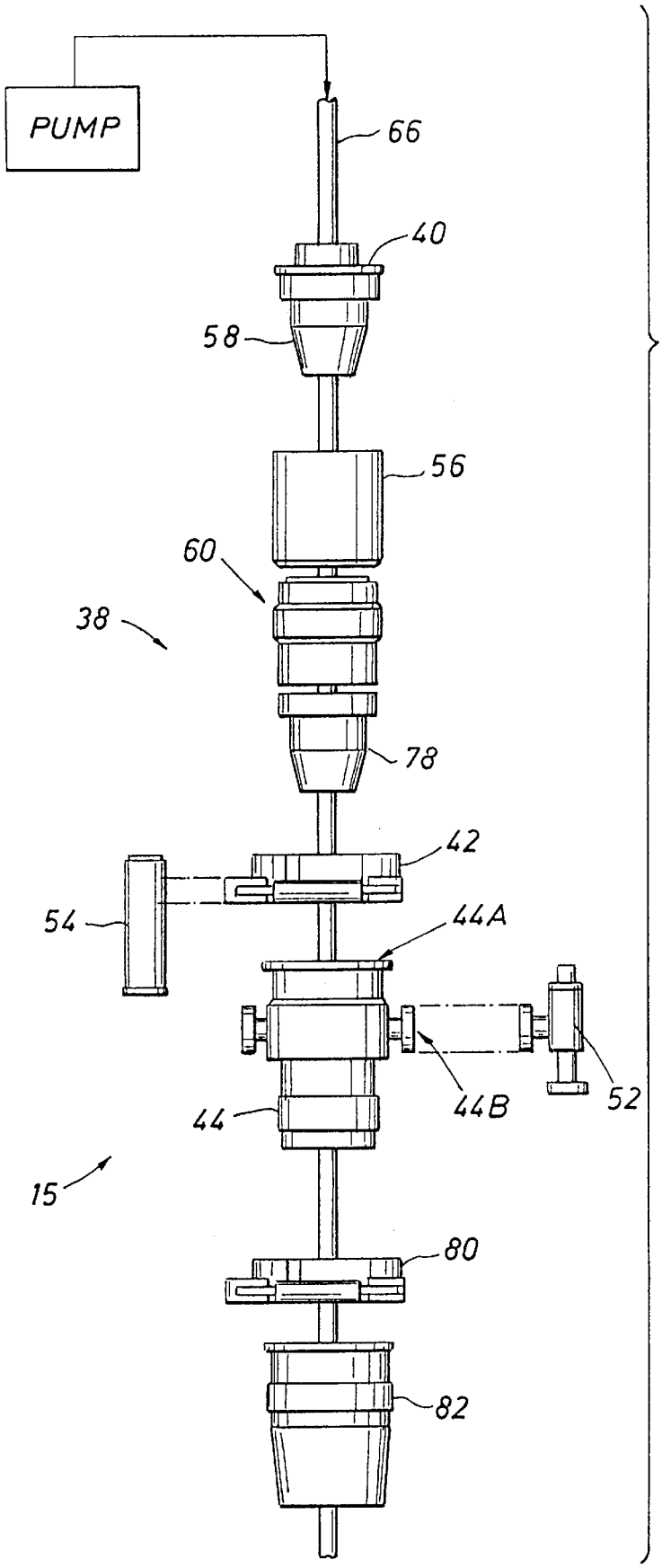
FIG. 4 is an exploded view of the present invention shown in FIG. 3.
Figure 5:
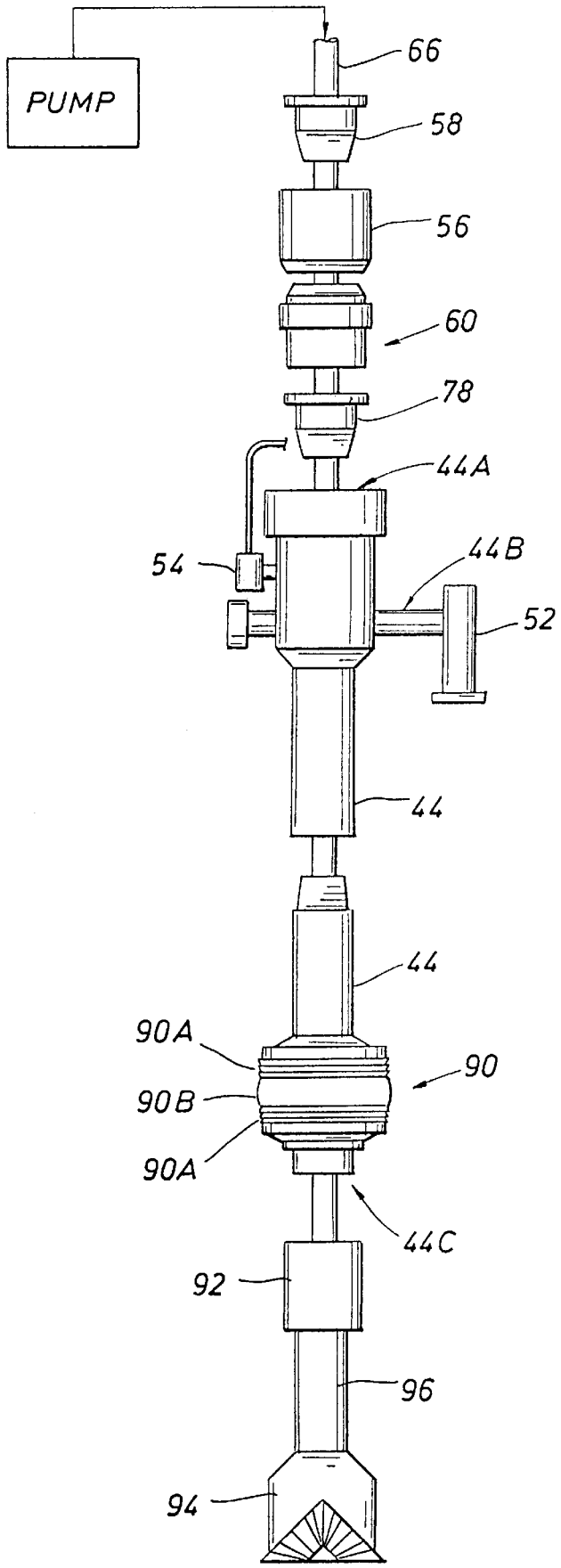
FIG. 5 is an exploded elevational view of the pressure housing assembly shown in FIG. 4, further including a fastening and sealing member that is actuated by a running collar connected to a drill string.
Figure 6:
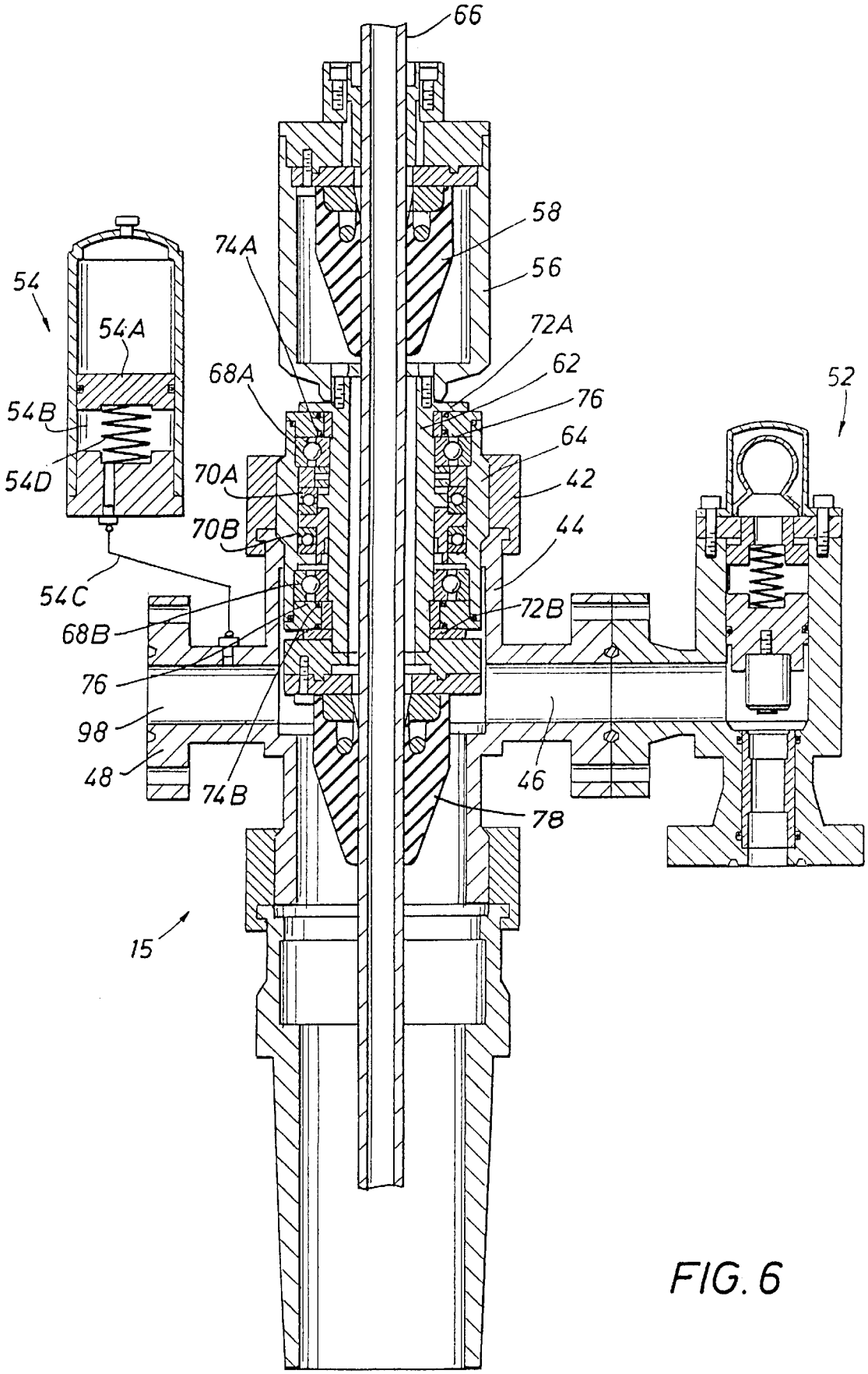
FIG. 6 is a section view of the pressure housing assembly as shown in FIG. 3.

Turning now to FIGS. 3 to 6, the pressure housing assembly 15 control head 38 would include a top rubber pot 56 containing a top stripper rubber 58, as best shown in FIGS. 4 and 6. The top rubber pot 56 is mounted to the bearing assembly, generally indicated at 60, having an inner member or barrel 62 and an outer barrel 64, as best shown in FIG. 6. The inner barrel 62 rotates with the top rubber pot 56 and its top stripper rubber 58 that seals with the drill string 66. A bottom stripper rubber 78 is also preferably attached to the inner barrel 62 to engage and rotate with the drill string 66. As can best be seen in FIGS. 5 and 6, the inner barrel 62 and outer barrel 64 are received in the first opening 44A of the housing 44 of the pressure housing assembly 15 and the pressure control device, generally indicated at 52, is connected to a second housing opening 44B of the housing 44 of the pressure housing assembly 15. The outer barrel 64, clamped and locked to the housing 44 by clamp 42, remains stationary with the housing 44 of the pressure housing assembly 15.

As disclosed in U.S. Pat. No. 5,662,181, and best shown in FIG. 6, radial bearings 68A and 68B, thrust bearings 70A and 70B, plates 72A and 72B, and seals 74A and 74B provide a sealed bearing assembly into which lubricant can be injected into lub fissures 76 at the top and bottom of the bearing assembly to thoroughly lubricate the internal sealing components of the bearing assembly. The self contained lubrication unit 54 provides subsea lubrication of the bearing assembly. As best shown in FIG. 6, the lubrication unit 54 would be pressurized by a spring-loaded piston 54A inside the unit 54 and pushed through tubing and flow channels to the bearings 68A, 68B and 70A, 70B. Sufficient amount of lubricant would be contained in the unit 54 to insure proper bearing lubrication of the assembly 15 until it is tripped out. The lubrication unit 54 would preferably be mounted on the upper housing 44. The chamber 54B on the spring side of the piston 54A, which contains the lubricant forced into the bearing assembly, could be in communication with the housing 44 of the pressure assembly by means of a tube 54C. This would assure that the force driving the piston 54A is controlled by the spring 54D, regardless of the water depth or internal well pressure. Alternately, the spring side of the piston 54A could be vented to the sea.

Turning now to FIG. 5, an exploded view of the preferred embodiment of the pressure housing assembly 15 is shown having a fastening and sealing assembly or packer assembly 90. In particular, the fastening and sealing assembly includes a packer assembly 90 positioned above the third housing opening 44C of the housing 44 to sealingly position the pressure housing assembly 15 in the casing 110. In particular, the packer assembly 90 will be sized so as to be able to seal against the internal diameter of the casing 110 in the subsea borehole, as discussed below. The packer assembly 90 will provide mechanical attachment of the pressure housing assembly 15 to the casing by means of radial expandable slips 90A. The packer assembly 90 will also provide a pressure seal by means of an outwardly expandable sealing element 90B. The packer assembly 90 will preferably have setting and release mechanisms which can be engaged and manipulated by running collar 92 affixed to the drill string 66. The running collar 92 is preferably fixed to the drill string 66 above the bit 94 and mud motor 96. The running collar 92 will transmit mechanical torque and axial forces to the setting mechanism in the packer assembly 90 during the setting process. After releasing the collar 92 from the packer assembly 90, the running collar 92 can continue down the well as part of the drilling assembly. When the bit 94 is tripped out, the running collar 92 will again be raised to the packer assembly 90 to unseat the packer slips 90A and sealing element 90B.

Figure 7:
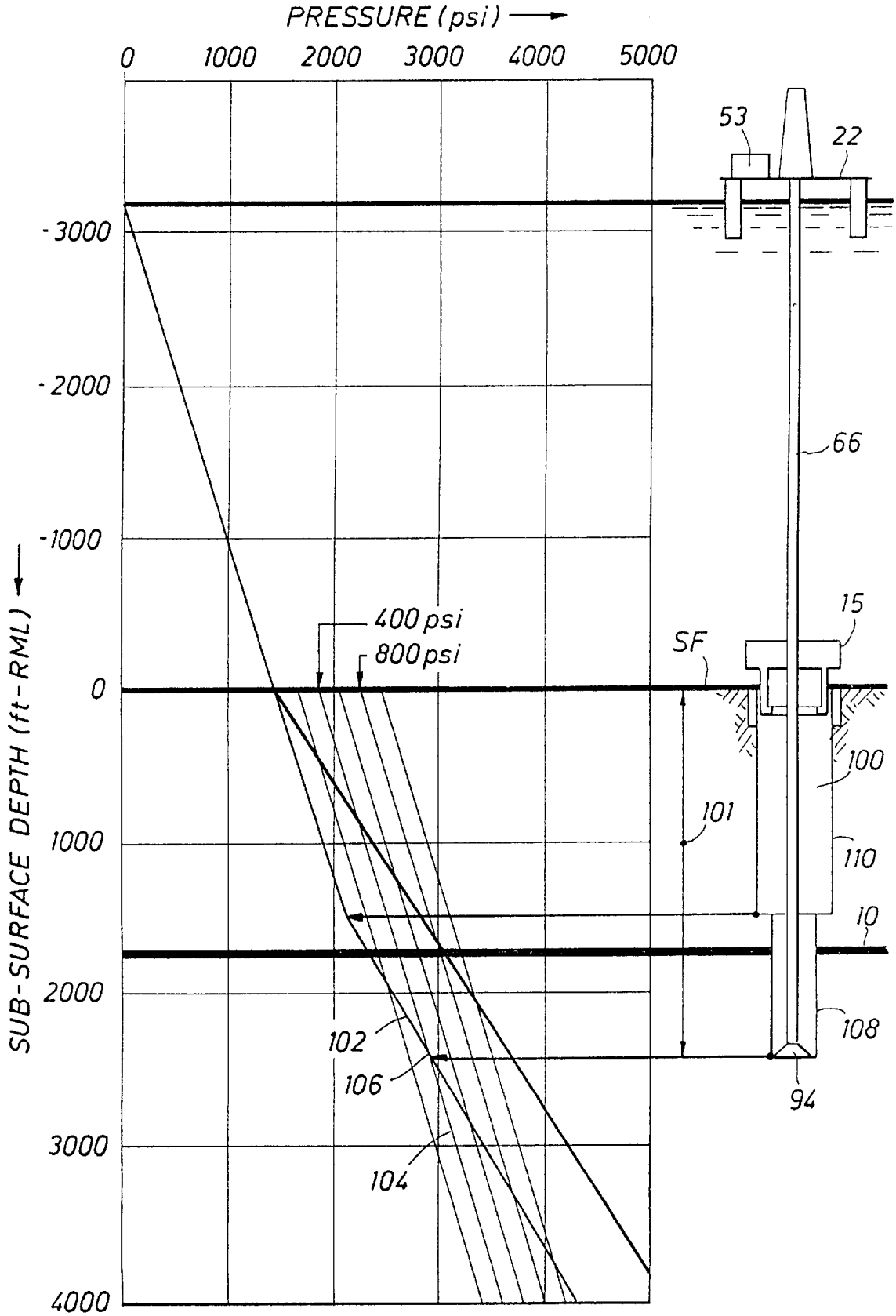
FIG. 7 is an elevational graphic view of the present invention using the pressure housing assembly as shown in FIGS. 3–6.

Turning now back to FIG. 6, the pressure control device or regulator 52 will be used as a primary pressure control device for the fluid in the annulus 100 of the well, as shown in FIG. 7. In the preferred pressure housing assembly 15, the regulator 52 opening pressure will be set on the floating vessel 22. After the pressure housing assembly 15 has been run and sealingly positioned, the pump 53 can be used to pressure up the well to the pressure regulator 52 pre-set opening pressure. Once the set pressure is achieved, the regulator 52 will open. After the regulator 52 opens, sea water will circulate down the drill string 66 out bit 94, up the annulus 100 and through the regulator 52, and preferably discharged at the sea floor SF. When the pump rate is increased the regulator 52 will open up in order to maintain pressure in the annulus 100 of the well at the regulator's pre-set pressure. When the pump rate is decreased the regulator 52 will begin closing in order to maintain pressure in the annulus 100 of the well at the regulator 52 set pressure. A back up or second pressure regulator (not shown) with a slightly higher pre-set pressure is preferably attached to a third return outlet 50 of housing 44 to act as a back up to the primary pressure regulator 52. If the primary pressure regulator 52 failed to operate properly and the pressure in the annulus 100 exceeded the secondary regulator set point, the secondary regulator would begin to operate.

Figure 8:
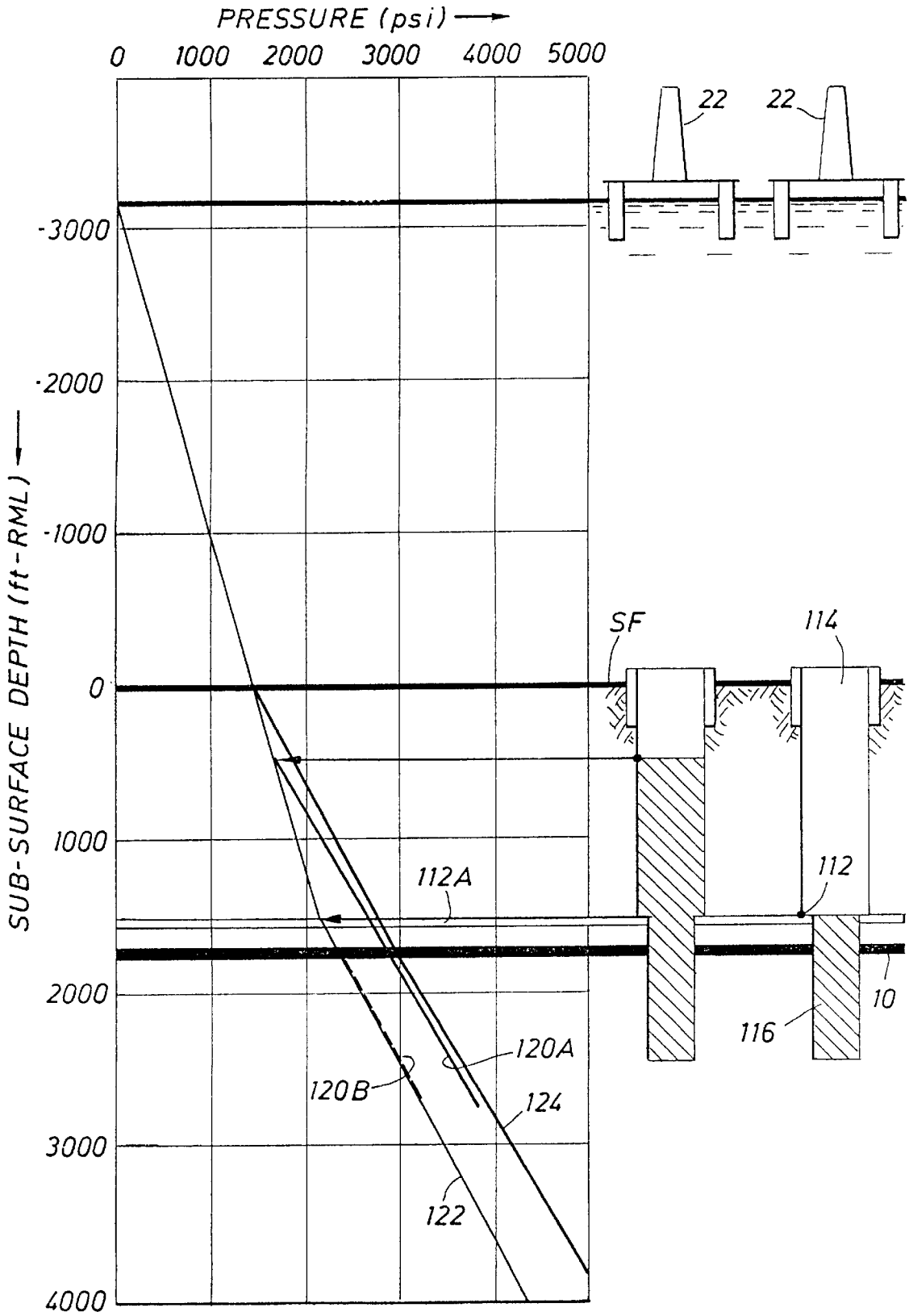
FIG. 8 is an elevational graphic view of the effects of losing fluid with additives at the casing shoe while performing the method of the present invention.

Turning to FIGS. 6 and 8, an orifice valve 98 is used for circulating a limited amount of fluid with additives (heavy mud) 116 into the borehole in preparation for tripping out the pressure housing assembly 15. The valve 98 would preferably have a removable orifice mounted in the valves outlet. The valve will remain closed until the pressure housing assembly 15 is ready to be tripped out of the hole. Before starting out of the hole with the bit 94, kill, fluid or heavy mud would be pumped into the annulus 100, as best shown in FIG. 7. As the mud interface begins moving up the annulus 100, the orifice valve 98 would be opened. The size of the orifice and pump rate would be pre-selected to provide enough back pressure on the annulus 100 to prevent the well from flowing. As the kill mud moved up the annulus 100, less pressure would be required to maintain a desired borehole pressure, so the pump rate would be gradually reduced. Once the kill mud reached the pressure housing assembly 15, the pump 53 would be shut off and the orifice valve opened. With the well static, the drill string 66 could be pulled, the packer assembly 90 unseated and the drilling assembly including the drill string 66 along with the pressure housing assembly 15 pulled, as discussed below in detail. A remotely controlled vehicle at the sea floor will preferably actuate the valve 98. Alternatively, the orifice valve 98 could be actuated using a pump rate signaling technique or drill pipe manipulation.

It is contemplated that additional refinements can be made to the present invention such as use of sensors for 1.) measuring the annular pressure at the control head 38, 2.) fluid ejection rate, and 3.) gas detection. Also remote operation of both the annular pressure regulator 52 and orifice valve 98 is contemplated. Also, remotely operated vehicles, as discussed above, and a remote intelligent control system could be used.

In particular, a sensor could be used for real-time mudline annular pressuremonitoring so that any failures in the system can be detected while drilling. Monitoring the mudline annular pressure during any shut in periods would help with the detection of abnormal pore pressure environments and casing shoe failures, as discussed below. Preferably, an existing measurement-while-drilling (MVD) tool outfitted with annular pressure sensors could be used. However, when using a MWD tool, pressures could only be transmitted when the well is being circulated and the data would be received at relatively slow transmission rates. Additionally, a fluid ejection rate sensor located on the fluid discharge outlets 46, 48 and 50 would be useful for early kick detection. Because the fluid is not circulated up to the floating vessel 22, in the present invention, the flow rate out, returned from the well, cannot be compared to the pump rate into the well. Real-time flow return monitoring would be useful for detecting casing shoe failures and loss circulation zones. Also, sensors for monitoring the presence or concentration of gas in the discharge flow stream would also be useful for early kick detection and will provide information about the subsurface environment being drilled.

Preferably, the pressure regulator 52 will be set while the device was on the rig and run into the well. If the pore pressure and fracture pressures are accurately predicted, this form of pressure regulation should be sufficient. If, however, the shallow aquifer 10 in the abnormal pore pressure environment contained higher pore pressures than expected, the drill string 66 with the pressure housing assembly 15 would have to be tripped to the sea surface so that the regulator 52 set pressure could be adjusted. If the annular regulator set pressure could be adjusted remotely during drilling, then there would not be a need for tripping the drill string 66. A remotely adjustable regulator would also eliminate need for the orifice valve 98 because the regulator set pressure could be reduced as kill mud was circulated up the annulus 100 prior to tripping the drill string 66.

If a remotely controlled pressure regulator, as discussed immediately above, is not used for annular pressure control, the orifice valve 98 would be the only component on the pressure housing assembly 15 which requires remote operation. The form of remote control could take any of several forms. For example, acoustic pulses from the floating vessel 22 could be transmitted through the sea water to a simple control system on the pressure housing assembly 15, once the control system received and confirmed the signal to open the orifice valve 98, it could actuate the valve by hydraulic, electrical, or mechanical means. The circulating pump 53 on the floating vessel could also be cycled in a special way to signal a mechanical or electrical device which would in turn actuate the valve 98. A third option would be to cycle the drill string 66 rotation speeds as a means of signaling the orifice valve 98 actuation. A conventional remotely operated vehicle could be used to both actuate the orifice valve 98 and inspect the wellhead 126 and pressure housing assembly 15 before tripping the drill string 66. The remotely operated vehicle could also be used to check for flow and make sure the well is dead after the circulating kill fluid 116 is moved into the annulus 100. The remotely operable vehicle could also be used to monitor pressure and actuate the orifice valve 98 when kill mud is being circulated, thereby eliminating the need for any special provisions for remotely actuating the orifice valve 98.

It is contemplated that the first prototype of the present invention will have a remotely operated vehicle docked to the pressure housing assembly 15 after it has been set and run. Annular pressure and flow rate could be continuously transmitted to the surface through the remotely operated vehicle umbilical and the remotely operated vehicle could be used to adjust the annular pressure regulator 52 set point. Also, it is contemplated that later models may use an on board computer which could take care of simple control functions and transmit data to the surface via acoustic, radio, laser, mud pulse, fiber-optic or an electrical style telemetry system. Instructions would also be sent to the on-board computer by one of the same forms of data transmission. A reliable system of this type could provide more flexibility and could prove cost effective by eliminating the need for any remotely operated vehicle intervention.

Turning now to FIG. 13, a subsea pressure housing assembly 15A, as discussed above, is mounted on top of an annular BOP preventer ABOP of a subsea blowout preventer stack BOPS connected to a wellhead 126. In this alternative embodiment, the casing type packer assembly 90 would not be used because it would interfere with the stack BOPS. The pressure housing assembly 15A would be mounted on top of the annular preventer ABOP (before running the BOP stack) using a fastening and sealing assembly 90'. Because the BOP stacks require a hose bundle to remotely actuate BOP components, the fastening and sealing assembly 90' could be a hydraulically actuated clamp, such as a Cameron HC Collet connector.

METHOD OF USE

Figure 1:
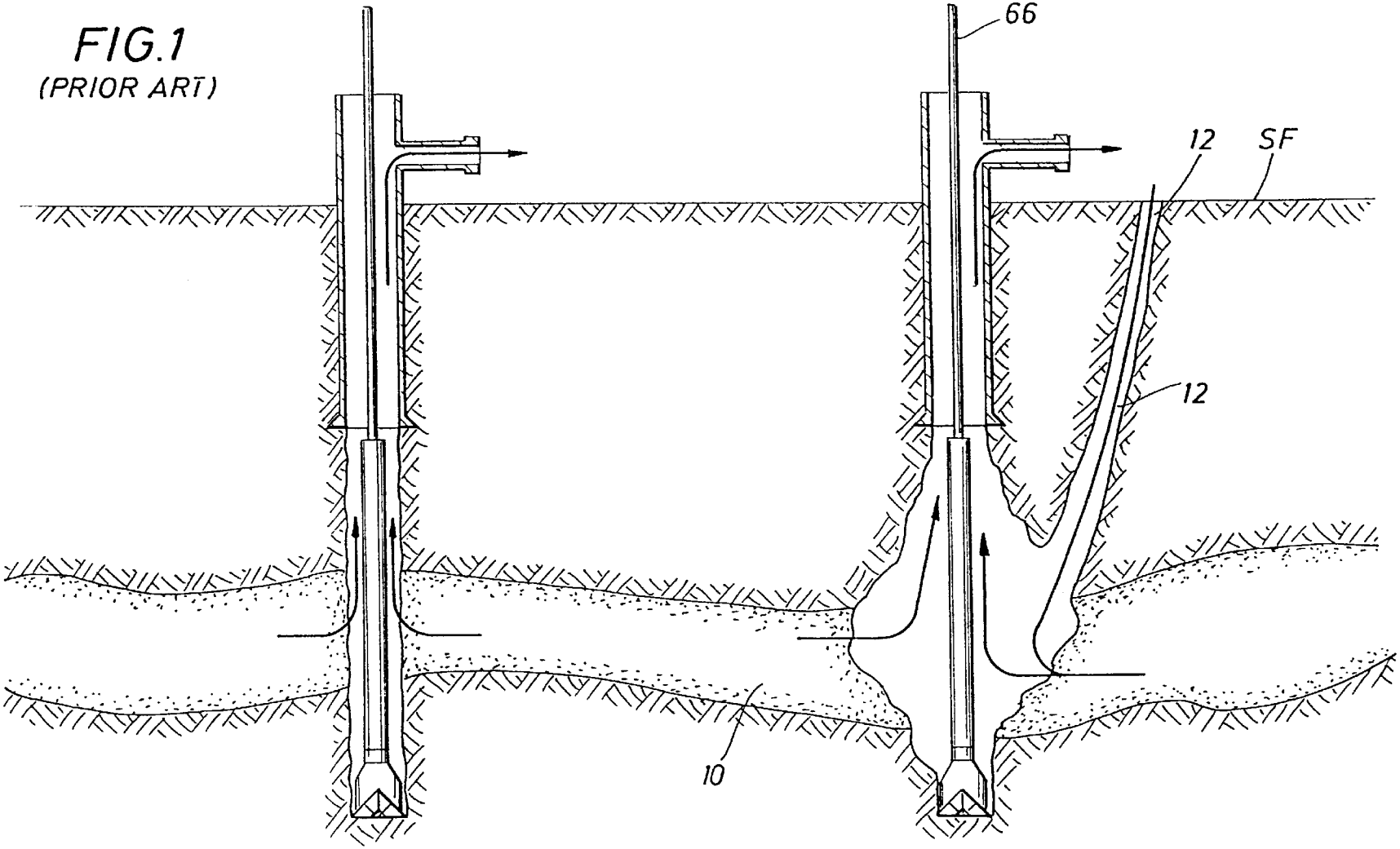
FIG.1 (PRIOR ART)
FIG. 1 is an elevational view of a drilling method where an abnormal pore pressure environment has resulted in an undesired flow path from the well to the sea floor.
Figure 2:
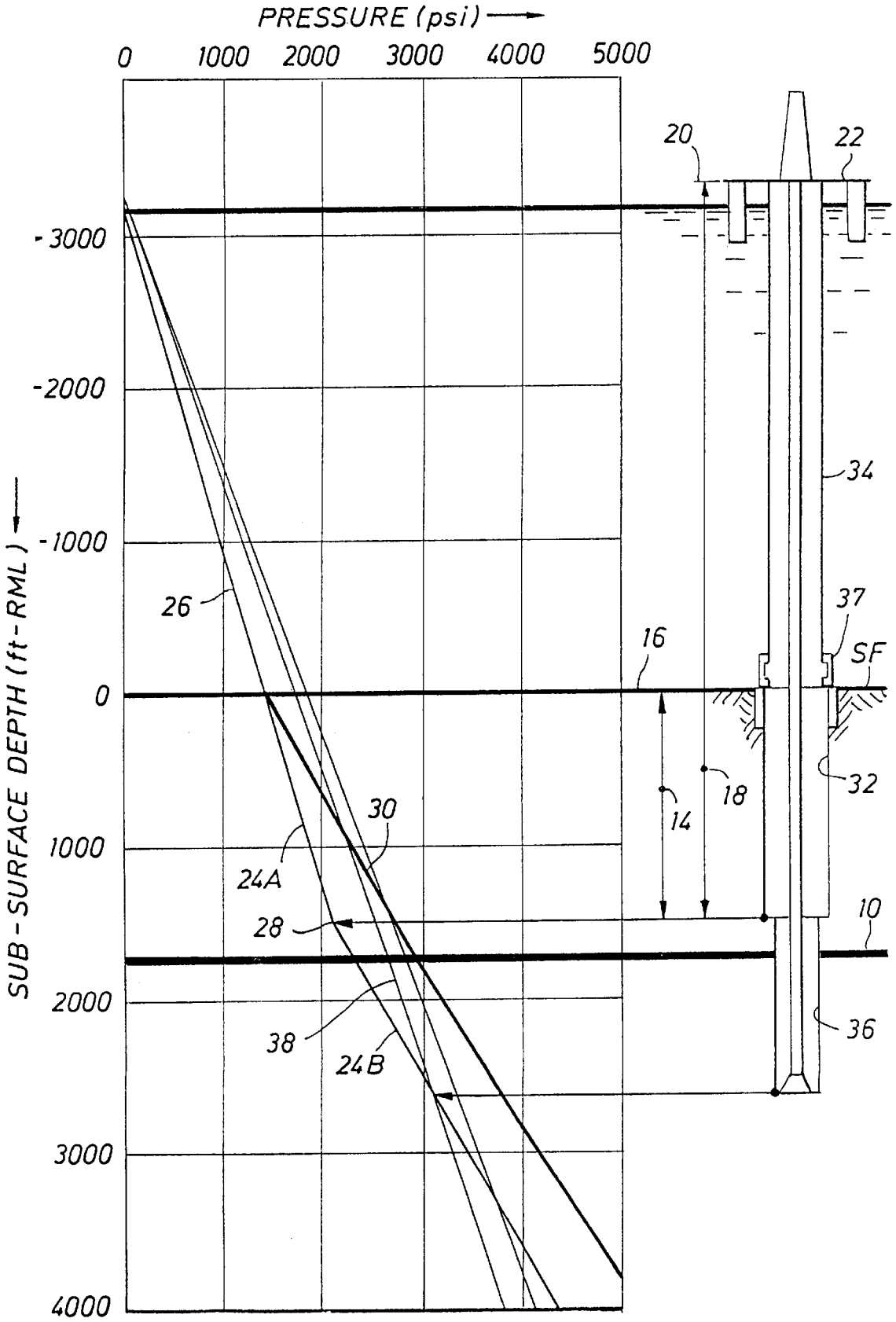
FIG. 2 (PRIOR ART)
FIG. 2 is an elevational graphic view of a floating vessel using a conventional riser for drilling through an abnormal pore pressure environment.
Figure 3:
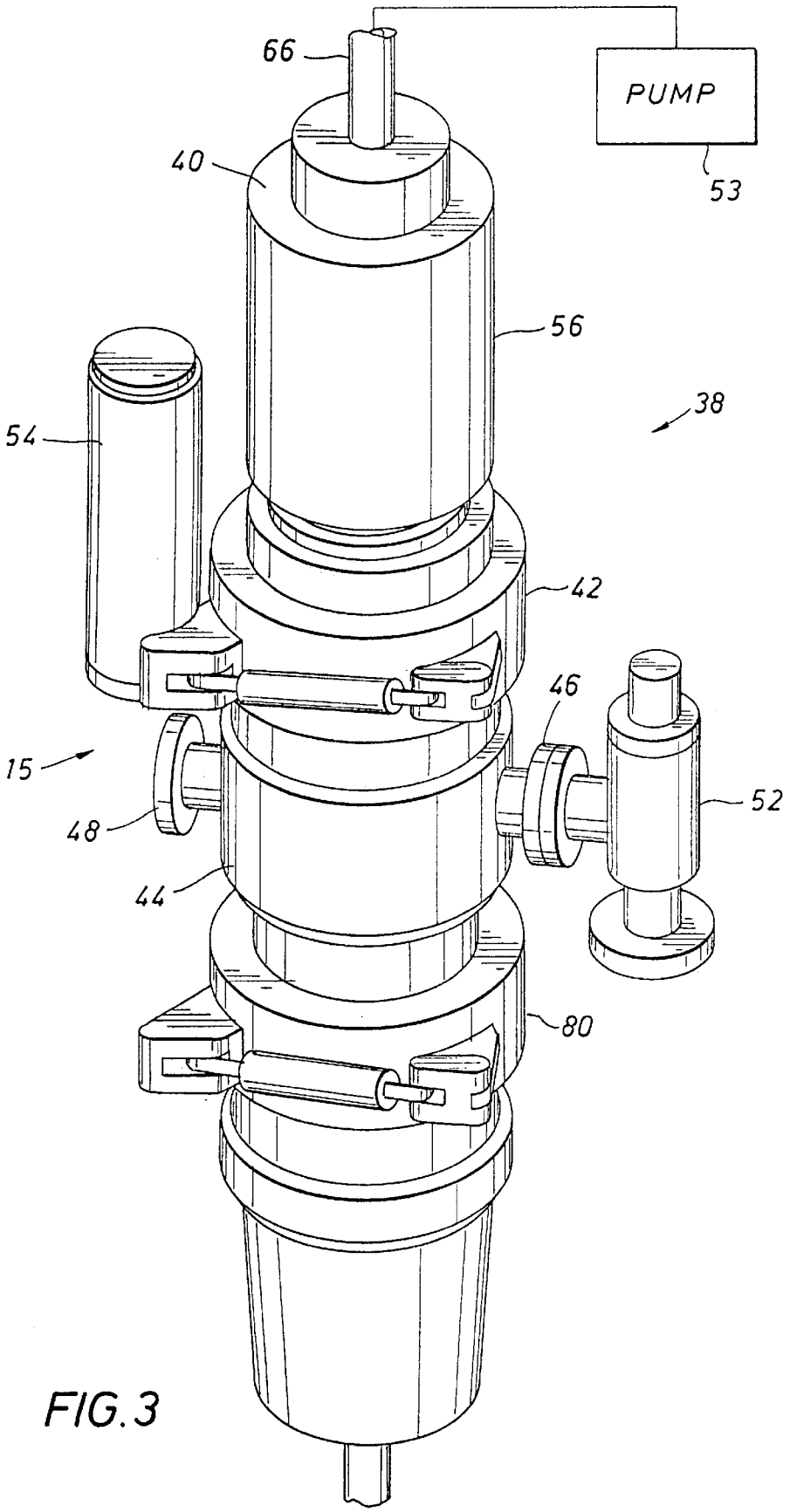
FIG. 3 is a perspective view of the pressure housing assembly of the present invention including a housing, a bearing assembly, a seal and a pressure control device.

Turning now to FIGS. 7–11A, 11B, and 11C the method for operation of the present invention is illustrated. In particular, FIG. 7 illustrates the possible casing size and setting depth selections for the first two casings run into an example well drilled to control borehole pressures using the method of the present invention. The properly installed pressure housing assembly 15, as discussed above, would maintain a back pressure on the fluid in the annulus 100 while drilling with the drill string 66. The pressure housing assembly 15 provides back pressure in addition to the hydrostatic pressure acting on the fluid in the annulus 100. This total pressure would allow the well to be drilled safely to a depth greater than 1500 feet while only using sea water as the drilling fluid. Since sea water is being used as the drilling fluid, a riser is not required since the drilling fluid can be discharged at the sea floor SF. Thus, while the present invention does not allow drilling to the final depth of the well without a riser, it does allow more of the well to be drilled without the riser. This riserless technology allows the second casing 108 to be larger than the inside diameter of the conventional riser, such as discussed above and shown in FIG. 2. If the pressure housing assembly 15 maintains a back pressure of 400 psi on the example well, as illustrated in FIG. 7, sea water having a density of 8.6 ppg could be used for the drilling fluid until a depth 101 of about 2,350 feet, that is below the shallow aquifer 10 and into the abnormal pore pressure environment. Below a depth of 2,350 feet-RML, the pore pressure in the sediments exceeds the total borehole pressure (fluid pressurization plus fluid hydrostatic pressure) which is generated by pressurizing the sea water an additional 400 psi. This depth is indicated at the intersection 106 of the pore pressure line 102 and the 400 psi line 104. Therefore, drilling below 2,350 feet in this example would require a heavier drilling fluid, that is a fluid with additives in order to prevent an uncontrolled flow from an abnormally pressured formation. As a consequence, a riser and a third casing would be required to drill below 2,350 feet, in this example. Since, neither the first or the second casing was required to pass through the conventional riser, importantly, as a result, a twenty-inch diameter second casing 108 may be set as deep as 2,350 feet. This is 850 feet deeper than with conventional drilling techniques without a riser, such as shown in FIG. 2. However, as seen in FIGS. 12A and 12B, if the example wells of FIGS. 2 and 7 are continued by selecting and setting successively smaller casings until the maximum total depth of the well was reached, significant increases in the possible maximum total depth of the well drilled is realized. FIG. 12A and FIG. 12B depict the pore pressure and overburden pressure for the example case developed in FIGS. 2, 7, and 8. FIG. 12A shows the casing program that would result if 16" casing were set at 2560 feet-RML with the conventional methods depicted in FIG. 2. The maximum total depth of the well would be 9200 feet-RML if 9⅝" diameter casing were to be used as production casing and 0.5 ppg safety margins were observed throughout the drilling of the well. FIG. 12B shows the casing program that would result if 20" casing were set at 2350 feet-RML using the riserless method depicted in FIG. 7. The maximum total depth for 9⅝" production casing would be 14,700 feet-RML if 0.5 ppg safety margins were used. By setting the 20" casing below the shallow water aquifers the well can be drilled a total of 5,500 feet deeper by using the riserless method described here.

In the example well of FIG. 7, using the present invention, a 200 psi safety margin was used similar to the safety margin of the example well of FIG. 2. Though, if a lower safety margin was used, casing 108 could be set even deeper than 2,350 feet.

Turning now to FIG. 8, because kill mud 116 will be circulated into the well after drilling the borehole, casing shoe safety margins can be considerably lower than conventional casing shoe pressure safety margins. FIG. 8 shows the well bore pressure profile 120A if 18 ppg kill fluid or mud is circulated to within 450 feet of the sea floor SF. Even if all the mud between the sea floor SF and the casing shoe 112 were lost in flow path 112A, the total pressure created by the column of sea water 114 (8.6 ppg) and the remaining mud 116 (18 ppg) is sufficient to maintain control of the well. This total pressure should control the shallow water aquifer 10 in the abnormal pore pressure environment thereby, as graphically shown, controlling the pore pressure either with an essentially full column of mud (as depicted with line 120A) or if the mud is lost down to the casing shoe 120B, (as depicted with line 120B). Both lines fall between the pore pressure 122 and fracture pressure 124 lines of abnormal pressure environment, thereby indicating the well is controlled in both conditions.

Figure 9:
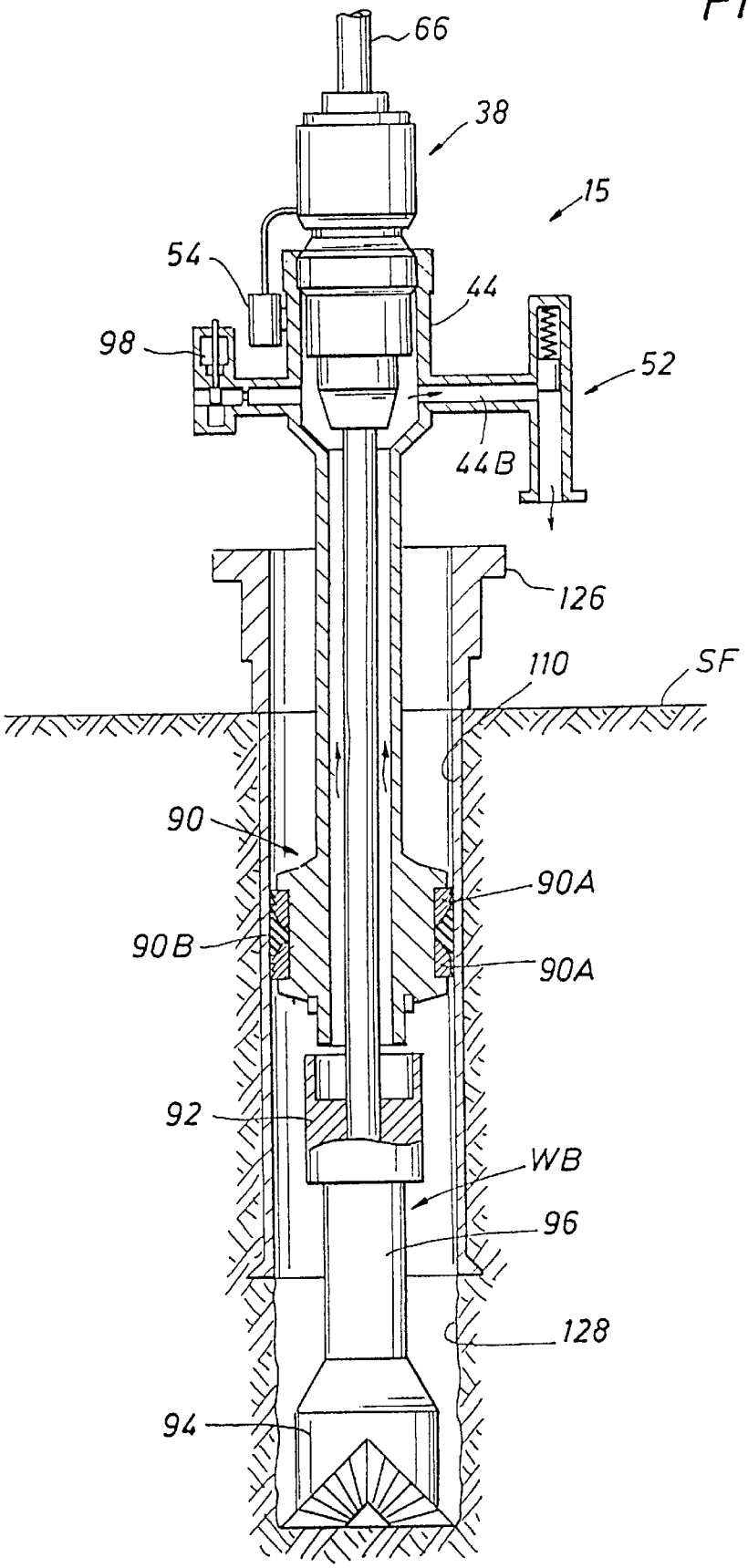
FIG. 9 is an elevational view of the preferred embodiment of the invention for drilling in a subsea borehole.

Turning to FIG. 9, the preferred pressure housing assembly 15 is shown positioned and sealed with the conductor casing 110. A wellhead 126 is attached to the conductor casing 110 above the sea floor SF. The pressure housing assembly 15 controls the back pressure on the borehole 128 using a pump 53 to pressurize the fluid in addition to the hydrostatic pressure created by the weight of a column of drilling fluid without additives, such as sea water. The preferred pressure housing assembly 15 includes a subsea lubricated rotating control head 38 and an adjustable constant pressure regulator 52 sealably positioned in the casing 110 by the packer assembly 90, as discussed above. The pressure housing assembly 15 maintains the borehole pressure to above the pore pressure of the abnormal pore pressure environment without using drilling fluid having a density above that of sea water. Therefore, after a single pass of the sea water through the annulus 110, it can be discharged from the pressure housing assembly 15 adjacent the sea floor SF. Above a critical depth of the borehole 128 beyond which the back pressure required to control flow in the abnormal pore pressure environment exceeds the current limitations of the equipment, fluid with additives or mud, and the resulting riser, would be necessary. Only when the drill string 66 is tripped out of the borehole 128 after drilling would a limited amount of fluid with additives be needed.

Figure 10:
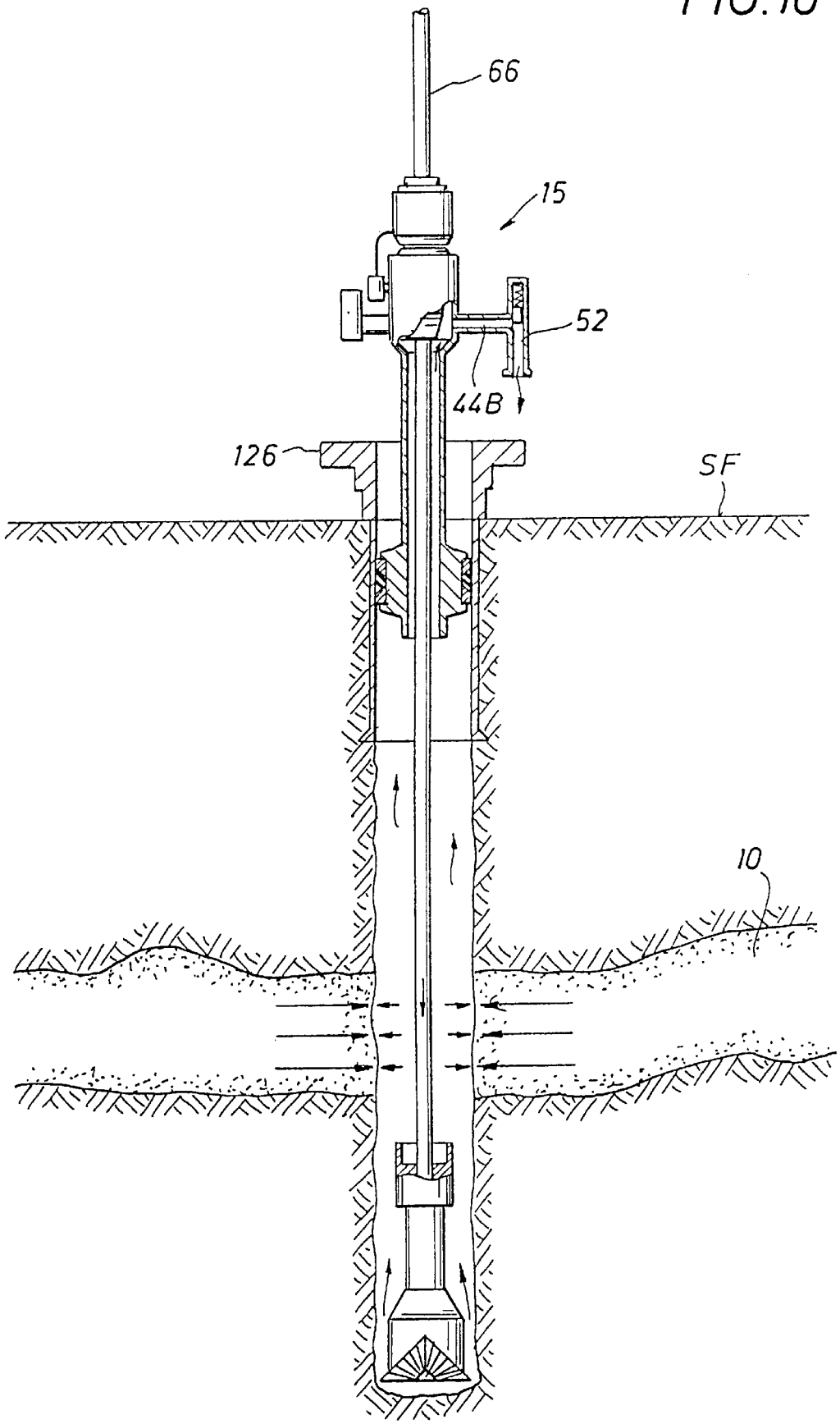
FIG. 10 is an elevational view of the preferred embodiment of the invention used to drill into an abnormal pore pressure environment including an abnormally pressured aquifer.

As shown in FIG. 9, the pressured housing assembly 15 would ride on top of a running collar 92 affixed to the drill string 66 above the drill bit 94 and mud motor 96. The pressure housing assembly 15, as shown in FIG. 9, will preferably be totally self-contained in that it would not need to be connected by lines to the floating vessel 22 and also would not require any special tools and flanges to be attached to the casing 110 before the pressure housing assembly 15 could be used. As discussed above, the fastening means 90A and sealing means 90B of the packer assembly 90 provide a pressure seal and mechanical attachment of the pressure housing assembly 15 to the inside of the casing 110 below the wellhead 126. The packer assembly 90 would be positioned below the wellhead 126 with the rotating control head 38 near the mudline of the sea floor SF. By rotating the drill string 66 from the floating vessel 22, which in turn would rotate the running collar 92, the packer assembly 90 would be set. Once the packer assembly 90 was set, the running collar 92 would disengage from the packer assembly 90 allowing the drill string 66 to continue into the borehole 128. The top stripper rubber 58 and bottom stripper rubber 78 would engage and seal around the drill string 66 isolating and containing annular fluids in the well bore WB. As best shown in FIG. 10, return flow of fluid from the well is routed through the pressure control device 52 in communication with the second housing opening 44B. This constant pressure regulator 52 or other choking device attached to the discharge manifold of housing 44 would regulate the well pressure by maintaining a back pressure on any abnormal pore pressure environment, including abnormally pressured aquifers 10. This back pressure would control any potential flow from the aquifer 10, even though the drilling fluid used is sea water.

Figure 11A:
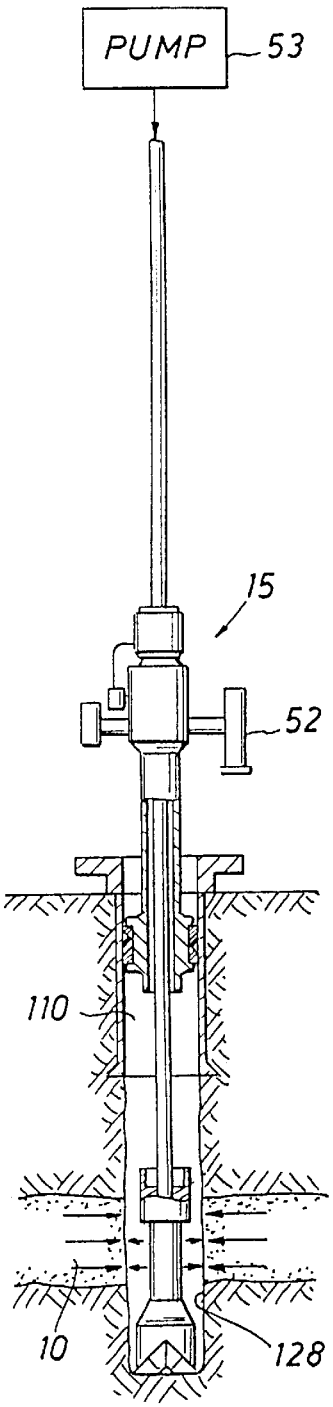
FIGS. 11A, 11B, and 11C are elevational views of the steps for removal of preferred embodiment of the invention after drilling into the abnormal pore pressure environment including disengaging the fastening and sealing member, as best shown in FIG. 11A, and removing the pressure housing assembly from the borehole using the running collar on a drill string, as best shown in FIGS. 11B and 11C.
Figure 11B:
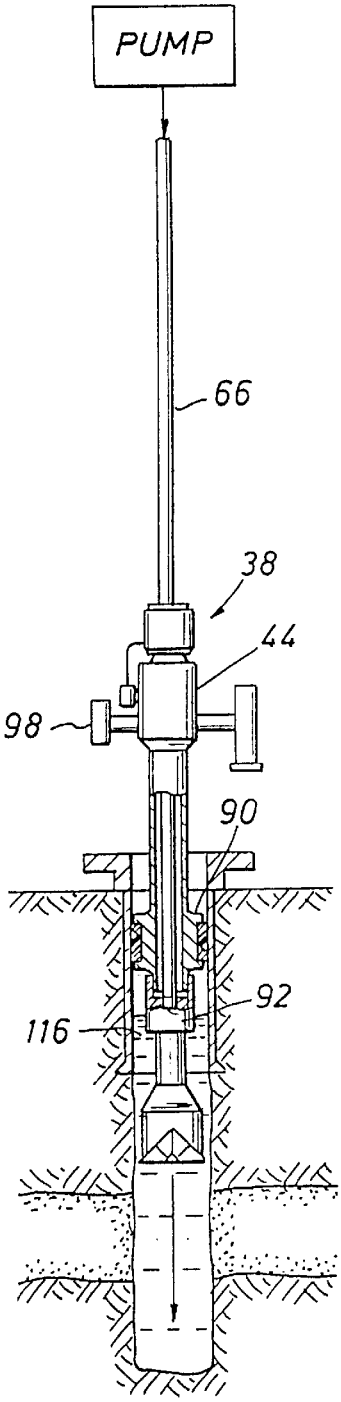
Figure 11C:
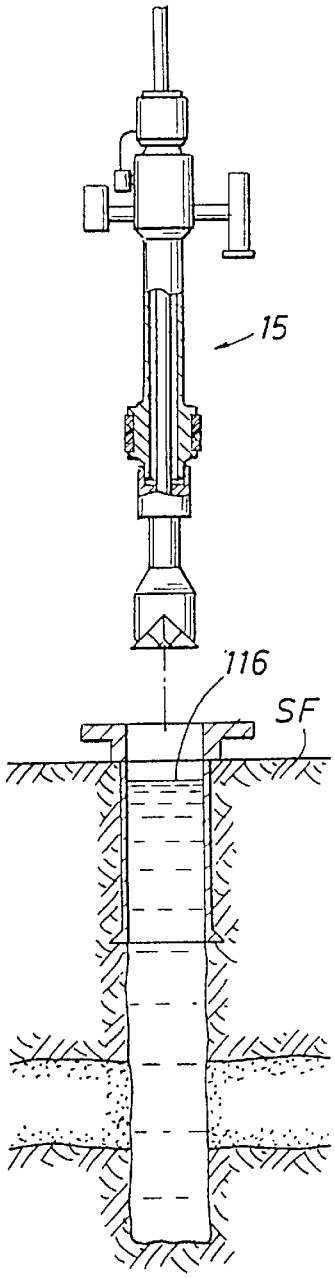

Turning now to FIGS. 11B and 11C as discussed above, when tripping out of the hole, a drilling fluid with additives or mud 116 would be pumped into the hole to maintain pressure on the borehole 128. The mud 116 would be circulated into the hole by means of a third remotely actuated valve 98 attached to the discharge manifold of the housing 44. This orifice valve 98 would have a sized orifice mounted in its outlet. Sea water would first be circulated at a pre-determined rate and the orifice valve opened. Once the orifice valve was opened, kill mud 116 would be pumped into the well. As the kill mud 116 moved up the annulus 110 more hydrostatic pressure would be placed on the hole 128. To offset this pressure increase, the pump 53 would be slowed down to reduce the back pressure. Once the kill mud reached the mudline of the sea floor SF, the back pressure would be reduced to zero. The running collar 92 would engage the packer assembly 90 at its bottom to release it. The whole self contained pressure housing assembly 15 would then be tripped up to the floating vessel 22 supported by the running collar 92. As discussed above, the mud 116 in the hole could prevent any flow from being produced. Although, this mud 116 would not be recovered when the casing 108 is run into the hole and the hole cemented, the waste would be limited to the volume of the well bore as best seen in FIGS. 8 and 11C.

After completing the casing of shallow, large diameter portion of the well, a conventional riser or other method could be used to drill the smaller diameter and deeper sections of the well. While the method and apparatus of the present invention is to be used where the drilling fluid can be economically discarded after a single pass, it offers a simple and effective aid in eliminating the physical and economic constraints associated with the initial phases of drilling a well in deep water.

It can now be understood that the maximum depth in which casing larger than the BOP stack or riser can be set controls the maximum total depth of the well and the maximum diameter of the final production casing. The advantages of larger production casings are higher production rate potentials and greater well bore utility for future drilling operations, such as side-tracking. As can now be seen, the subsea pressure housing assembly 15, when applied to riserless drilling, increases the maximum total depth to which a well can be drilled in a given water depth by increasing the depth that can be drilled before a riser becomes necessary. Substantial cost savings can also be realized by using smaller floating vessels (without riser capabilities) to drill the shallow, large-diameter hole sections to a depth below the high risk shallow water aquifers. Casing could then be set to seal off the water flows, and the location could then be temporarily abandoned until a larger floating vessel was available to finish drilling the well to the target objective. The smaller floating vessel needed for the present invention would be cheaper to operate than the current large floating vessels. Also, if wells were lost because of water flows, the financial impact would be much less than if the shallow high risk section of the wells were drilled with a larger floating vessel. This cost effective site preparation using the subsea pressure housing assembly 15, 15A could lead to some large drilling contractors offering turn-key packages for drilling the large diameter, shallow sections of deep water wells. As the technology matures, small specialized and relatively cheap floating vessels could be built to quickly and efficiently prepare well sites by drilling into the abnormal pore pressure environment and setting larger diameter surface casing. Large diameter coil tubing could even be developed to further increase the efficiency of these site preparation vessels. It is to be understood that tubular as defined herein includes for rotatable drill pipe, coil tubing and other similar tubing.

The foregoing disclosure and description of the invention are illustrative and explanatory thereof, and various changes in the details of the illustrated apparatus and construction and method of operation may be made without departing from the spirit of the invention.

What is claimed is:

1. Method for controlling a subsea borehole fluid pressure, comprising the steps of:

positioning a portion of a tubular below the subsea mudline and within a normal pore pressure environment;

moving a fluid in the tubular that exerts a pressure less than a pore pressure of an abnormal pore pressure environment;

pressurizing the fluid with a pump to increase the fluid pressure to control the pore pressure of the abnormal pore pressure environment, and forming a borehole below the tubular and into the abnormal pore pressure environment while controlling the pore pressure of the abnormal pore pressure environment with the fluid that exerts a pressure less than the pore pressure of the abnormal pore pressure environment before being pressurized by said pump.

2. Apparatus for controlling a subsea borehole fluid pressure adapted for use with a portion of a tubular positioned below the mudline and within a normal pore pressure environment, comprising:

a pump for moving a fluid in the tubular, said fluid exerting a pressure less than a pore pressure of an abnormal pore pressure environment said fluid being pressurized by the pump to control the pore pressure of the abnormal pore pressure environment, and a forming device for forming a borehole below the tubular and into the abnormal pore pressure environment while controlling the pore pressure of the abnormal pore pressure environment with the fluid that exerts a pressure less than the pore pressure of the abnormal pore pressure environment before being pressurized by said pump.

3. Apparatus of claim 2 further comprising:

a housing having a first housing opening, a second housing opening and a third housing opening;

a bearing assembly having a inner member and an outer member and disposed with said first housing opening, said inner member rotatable relative to said outer member and having a passage through which a string may extend;

a seal to sealably engage the string with the inner barrel;

a pressure control device in communication with said second housing opening to control pressure in said housing; and said third housing opening sealingly positioned with the tubular.

4. Apparatus adapted for use with a tubular for controlling a subsea borehole fluid pressure while drilling in an abnormal pore pressure environment, comprising:

a housing having a first housing opening, a second housing opening and a third housing opening;

a string extending in said first opening;

a seal to sealably engage the string;

a pressure control device in communication with said second housing opening to control pressure in said housing;

said third housing opening sealingly positioned with the tubular; and a pump for pumping fluid and for pressurizing the fluid in the borehole, said fluid, exerting a pressure less than the pore pressure of the abnormal pore pressure environment before being pumped, being pressurized by said pump and maintained by said pressure control device to control the abnormal pore pressure environment while drilling the borehole in the abnormal pore pressure environment with the fluid that exerts a pressure less than the pore pressure of the abnormal pore pressure environment before being pressurized by said pump.

5. Apparatus of claim 4 further comprising a fastening and sealing assembly to sealingly position said third housing opening with the tubular.

6. Method for controlling a subsea borehole fluid pressure between a pore pressure and a fracture pressure of a subsea borehole, comprising the steps of:

supporting a portion of the subsea borehole with a support structure;

sealingly positioning a housing with the support structure;

sealingly positioning a string with the housing so that the string extends through the housing and into the borehole;

moving a fluid, that exerts a pressure less than a pore pressure of an abnormal pore pressure environment, from the string into the support structure; and controlling the pressure of the fluid in the borehole between a borehole pressure substantially equal to or greater than the pore pressure of the abnormal pore pressure environment, and a borehole pressure substantially equal to or less than the fracture pressure of the abnormal pore pressure environment using a pump while drilling in the abnormal pore pressure environment with the fluid that exerts a pressure less than the pore pressure of the abnormal pore pressure environment before being pressurized by said pump.

7. Apparatus adapted for use with a tubular and a rotatable string for controlling subsea borehole fluid pressure while drilling in an abnormal pore pressure environment, comprising:

a housing having a first housing opening, a second housing opening and a third housing opening;

a bearing assembly having an inner member and an outer member and disposed with said first housing opening, said inner member rotatable relative to said outer member and having a passage through which the string may extend;

a seal to sealably engage the string with the inner barrel;

a pressure control device in communication with said second housing opening to control pressure in said housing;

said third housing opening sealingly positioned with the string; and a pump for pumping a fluid, that exerts a pressure less than a pore pressure of the abnormal pore pressure environment before being pumped, and for pressurizing the fluid, said bearing assembly, said seal, and said pressure control device provide a fluid in a subsea borehole for controlling the subsea borehole fluid pressure while drilling in the abnormal pore pressure environment with the fluid that exerts a pressure less than the pore pressure of the abnormal pore pressure environment before being pressurized by said pump.

8. Apparatus of claim 7 further comprising a fastening and sealing assembly to sealingly position said third housing opening with the tubular.

9. Method for controlling a subsea borehole fluid pressure, comprising the steps of:

casing a portion of the subsea borehole;

sealingly positioning a housing with the casing;

sealingly positioning a tubular with the housing so that the tubular extends through tho housing and into the borehole;

rotating the tubular relative to the housing while maintaining the seal between the tubular and the housing;

moving fluid, that exerts a pressure less than the pore pressure of an abnormal pore pressure environment from the tubular into the borehole;

controlling the pressure of the fluid in the borehole as the borehole extends into an abnormal pore pressure environment; and moving fluid from said housing into the sea.

10. Apparatus adapted for use with a tubular and a rotatable string having a bit for controlling a subsea borehole fluid pressure, comprising:

a housing having a first housing opening, a second housing opening and a third housing opening;

a sealed bearing assembly having an inner barrel and an outer barrel and disposed with said first housing opening, said inner barrel rotatable relative to said outer barrel and having a passage through which the string having a bit may extend;

a seal moving with said inner barrel to sealably engage the string;

a pressure control device in communication with said second housing opening to control pressure in said housing;

a fastening and sealing assembly disposed adjacent to said third housing opening to sealably engage said housing with the tubular; and a pump for pumping fluid, exerting a pressure less than a pore pressure of an abnormal pore pressure environment before being pumped, and for pressurizing the fluid in the borehole, said pump, said sealed bearing assembly, said seal, said pressure control device and said fastening and sealing assembly control the pore pressure of the abnormal pore pressure environment while rotating the bit in the subsea borehole independent of closing a non-rotating blowout preventer around the string.

11. Apparatus of claim 10 further comprising a subsea lubrication unit for injecting lubrication into said sealed bearing assembly.

12. Method for controlling a subsea borehole fluid pressure, comprising the steps of:

supporting a portion of a subsea borehole with a supporting structure;

sealingly positioning a housing with the supporting structure;

sealingly positioning a string with the housing so that the string extends through and the housing and into the borehole, rotating the string relative to the housing while maintaining the seal between the string and the housing;

moving a fluid, that exerts a pressure less than a pore pressure of an abnormal pore pressure environment before being pressurized, into the borehole; and increasing the pressure of said fluid in the borehole with a pump while continuing the step of rotating the string in the abnormal pore pressure environment.

13. Method of claim 12 wherein said housing having a first housing opening, a second housing opening and a third housing opening, and further comprising:

a bearing assembly having an inner member and an outer member and disposed with said first housing opening, said inner member rotatable relative to said outer member and having a passage through which the string may extend;

a seal to sealably engage the string with the inner barrel; and a pressure control device in communication with said second housing opening to control pressure in the housing.

14. Method of claim 13 further comprising:

said third housing opening sealingly positioned with the supporting structure; and a pump for pumping fluid and for pressurizing the fluid in the borehole whereby said fluid being pressurized by said pump and maintained by said pressure control device while drilling the borehole through an abnormal pore pressure environment.

15. Method of claim 12 further comprising the step of pumping a kill fluid at a variable rate to maintain a desired borehole pressure.

16. Method of claim 13 further comprising the step of pumping a kill fluid at a variable rate to maintain a desired borehole pressure.

17. Method for controlling a subsea borehole fluid pressure, comprising the steps of:

supporting a portion of a subsea borehole with a supporting structure;

sealingly positioning a housing with the supporting structure;

sealingly positioning a string with the housing so that the string extends through the housing and into the borehole;

rotating the string relative to the housing while maintaining a seal between the string and the housing; wherein said housing having a first housing opening, a second housing opening and a third housing opening, and further comprising:

a bearing assembly having an inner member and an outer member and disposed with said first housing opening, said inner member rotatable relative to said outer member and having a passage through which the string may extend, and the seal sealably engaging the string with the inner barrel;

moving a fluid into the borehole;

increasing the pressure of the fluid in the borehole;

a pressure control device in communication with said second housing opening to control pressure in the housing;

said housing having a fourth housing opening;

an orifice in communication with said fourth housing opening, said orifice having a predetermined size to provide sufficient back pressure in the borehole to control the subsea borehole fluid pressure.

18. Method for controlling a subsea borehole fluid pressure, comprising the steps of:

supporting a portion of a subsea borehole with a supporting structure;

sealingly positioning a housing with the supporting structure;

positioning a string with the housing so that the string extends through the housing and into the borehole;

rotating the string relative to the housing while maintaining a seal between the string and the housing; wherein said housing having a first housing opening, a second housing opening and a third housing opening, and further comprising:

a bearing assembly having an inner member and an outer member and disposed with said first housing opening, said inner member rotatable relative to said outer member and having a passage through which the string may extend; and the seal sealably engaging the string with the inner barrel;

moving a fluid into the borehole;

increasing the pressure of the fluid in the borehole;

a pressure control device in communication with said second housing opening to control pressure in the housing; and closing an orifice until the housing is ready to be removed from the borehole, said orifice in communication with said third housing opening, said orifice having a predetermined size to provide sufficient back pressure in the borehole to control the subsea borehole fluid pressure.

* * * * *

UNITED STATES PATENT AND TRADEMARK OFFICE

CERTIFICATE OF CORRECTION

PATENT NO. : 6,138,774
APPLICATION NO. : 09/033190
DATED : October 31, 2000
INVENTOR(S) : Adam T. Bourgoyne, Jr., Darryl A Bourgoyne and Tammy T. Bourgoyne It is certified that error appears in the above-identified patent and that said Letters Patent is hereby corrected as shown below:

column 1, on line 23, delete the comma "," immediately after "fluid";
on line 24, delete "formations" and replace with -- formation --; and
on line 31, delete "environments" and replace with -- environment --.

column 2, on line 9, insert a comma --,-- immediately after "formation".

column 3, on line 1, delete "increase" and replace with -- increased --;
on line 3, delete "run" and replace with -- runs --;
on line 6, delete "a" and replace with -- an --; and
on line 33, delete the dash "-" immediately after "at".

column 7, on line 28, insert a space between "pressure" and "monitoring";
on line 33, delete "(MVD)" and replace with -- (MWD) --.

column 9, on line 24, delete the comma "," immediately after "Since"; and
on line 24, delete "or" and replace with -- nor --.

column 10, on line 24, delete "110" and replace with -- 100 --.

column 11, on line 9, delete "110" and replace with -- 100 --.

In the claims, on line 4 of claim 3, delete "a" immediately after "having" and replace with --an--;
on line 9 of claim 3, delete "barrel" and replace with -- member --;
on line 12 of claim 7, delete "barrel" and replace with -- member --;

UNITED STATES PATENT AND TRADEMARK OFFICE

CERTIFICATE OF CORRECTION

PATENT NO. : 6,138,774
APPLICATION NO. : 09/033190
DATED : October 31, 2000
INVENTOR(S) : Adam T. Bourgoyne, Jr., Darryl A Bourgoyne, and Tammy T. Bourgoyne It is certified that error appears in the above-identified patent and that said Letters Patent is hereby corrected as shown below:

on line 6 of claim 9, delete “tho” and replace with -- the --;
on line 11 of claim 9, add the comma --,-- immediately after “environment”;
on line 8 of claim 12, delete “and” immediately after “through”;
on line 9 of claim 13, delete “barrel” and replace with -- member --;
on line 21 of claim 17, delete “barrel” and replace with -- member --; and
on line 20 of claim 18, delete “barrel” and replace with -- member --.

Signed and Sealed this

Fifth Day of September, 2006

JON W. DUDAS
*Director of the United States Patent and Trademark Office*